US010125983B2

(12) United States Patent
Colannino et al.

(10) Patent No.: US 10,125,983 B2
(45) Date of Patent: Nov. 13, 2018

(54) HIGH OUTPUT POROUS TILE BURNER

(71) Applicant: CLEARSIGN COMBUSTION CORPORATION, Seattle, WA (US)

(72) Inventors: Joseph Colannino, Bellevue, WA (US); Douglas W. Karkow, Des Moines, WA (US); Christopher A. Wiklof, Everett, WA (US)

(73) Assignee: CLEARSIGN COMBUSTION CORPORATION, Seattle, WA (US)

( * ) Notice: Subject to any disclaimer, the term of this patent is extended or adjusted under 35 U.S.C. 154(b) by 92 days.

(21) Appl. No.: 15/235,517

(22) Filed: Aug. 12, 2016

(65) Prior Publication Data

US 2016/0348900 A1 Dec. 1, 2016

Related U.S. Application Data

(63) Continuation-in-part of application No. PCT/US2015/016152, filed on Feb. 17, 2015, which is a continuation-in-part of application No. PCT/US2014/016632, filed on Feb. 14, 2014, application No. 15/235,517, which is a continuation-in-part of application No. 14/763,271, filed as application No. PCT/US2014/016628 on Feb. 14, 2014, now Pat. No. 9,857,076, application No. 15/235,517, which is a continuation-in-part of (Continued)

(51) Int. Cl.

| | |
|---|---|
| ***F23D 14/04*** | (2006.01) |
| ***F23D 14/70*** | (2006.01) |
| ***F23N 5/02*** | (2006.01) |
| ***F23D 14/14*** | (2006.01) |

(52) U.S. Cl.
CPC ..... *F23D 14/70* (2013.01); *F23D 14/14* (2013.01); *F23N 5/022* (2013.01); *F23N 2029/20* (2013.01)

(58) Field of Classification Search
CPC ..... F23D 14/14
USPC ..... 431/7, 253, 328
See application file for complete search history.

(56) References Cited

U.S. PATENT DOCUMENTS 2,095,065 A 10/1937 Hays
3,324,924 A 6/1967 Hailstone et al.
(Continued)

FOREIGN PATENT DOCUMENTS

JP 2006-275482 10/2006
WO WO 1995/000803 1/1995
(Continued)

OTHER PUBLICATIONS

Arnold Schwarzenegger, "A Low NOx Porous Ceramics Burner Performance Study," California Energy Commission Public Interest Energy Research Program, Dec. 2007, San Diego State University Foundation, p. 5.

(Continued)

*Primary Examiner* — Avinash Savani
(74) *Attorney, Agent, or Firm* — Christopher A. Wiklof; David Conlee; Launchpad IP, Inc.

(57) ABSTRACT

A method of operation of a burner system includes introducing a fuel stream into a perforated flame holder, combusting the fuel stream, with a majority of the combustion occurring between an input face and an output face of the flame holder, and producing a heat output from the combustion of at least 1.5 kBTU/H/in$^2$.

18 Claims, 12 Drawing Sheets

Related U.S. Application Data application No. 15/215,401, filed on Jul. 20, 2016, which is a continuation-in-part of application No. PCT/US2014/012843, filed on Jan. 26, 2015.

(60) Provisional application No. 61/765,022, filed on Feb. 14, 2013, provisional application No. 61/931,407, filed on Jan. 24, 2014.

(56) References Cited

U.S. PATENT DOCUMENTS

| | | | | |
|---|---|---|---|---|
| 4,021,188 | A | 5/1977 | Yamagishi et al. | |
| 4,081,958 | A | 4/1978 | Schelp | |
| 4,408,461 | A | 10/1983 | Bruhwiler et al. | |
| 4,483,673 | A | 11/1984 | Murai et al. | |
| 4,588,373 | A * | 5/1986 | Tonon | F24C 3/14 126/39 J |
| 4,643,667 | A | 2/1987 | Fleming | |
| 4,673,349 | A | 6/1987 | Abe et al. | |
| 4,726,767 | A | 2/1988 | Nakajima | |
| 4,752,213 | A | 6/1988 | Grochowski et al. | |
| 4,773,847 | A | 9/1988 | Shukla et al. | |
| 5,275,552 | A | 1/1994 | Schwartz et al. | |
| 5,326,257 | A | 7/1994 | Taylor et al. | |
| 5,409,375 | A | 4/1995 | Butcher | |
| 5,439,372 | A * | 8/1995 | Duret | F23D 14/02 431/2 |
| 5,441,402 | A | 8/1995 | Reuther et al. | |
| 5,641,282 | A | 6/1997 | Lee et al. | |
| 5,718,573 | A | 2/1998 | Knight et al. | |
| 5,993,192 | A * | 11/1999 | Schmidt | F23D 14/18 431/12 |
| 6,997,701 | B2 | 2/2006 | Volkert et al. | |
| 9,377,190 | B2 | 6/2016 | Karkow et al. | |
| 9,388,981 | B2 | 7/2016 | Karkow et al. | |
| 9,447,965 | B2 | 9/2016 | Karkow et al. | |
| 2002/0155403 | A1 | 10/2002 | Griffin et al. | |
| 2003/0054313 | A1 | 3/2003 | Rattner et al. | |
| 2004/0058290 | A1 | 3/2004 | Mauzey et al. | |
| 2004/0197719 | A1 | 10/2004 | Chung et al. | |
| 2006/0084017 | A1 | 4/2006 | Huebner et al. | |
| 2006/0141413 | A1 | 6/2006 | Masten et al. | |
| 2008/0124666 | A1 | 5/2008 | Stocker et al. | |
| 2010/0178219 | A1 | 7/2010 | Verykios et al. | |
| 2011/0076628 | A1 | 3/2011 | Miura et al. | |
| 2011/0076629 | A1 | 3/2011 | Mosiewicz | |
| 2012/0164590 | A1 | 6/2012 | Mach | |
| 2012/0231398 | A1 | 9/2012 | Carpentier et al. | |
| 2015/0118629 | A1 | 4/2015 | Colannino et al. | |
| 2015/0276217 | A1 | 10/2015 | Karkow et al. | |
| 2015/0285491 | A1 | 10/2015 | Karkow et al. | |
| 2015/0330625 | A1 | 11/2015 | Karkow et al. | |
| 2015/0362177 | A1 | 12/2015 | Krichtafovitch et al. | |
| 2015/0362178 | A1 | 12/2015 | Karkow et al. | |
| 2015/0369477 | A1 | 12/2015 | Karkow et al. | |
| 2016/0003471 | A1 | 1/2016 | Karkow et al. | |
| 2016/0018103 | A1 | 1/2016 | Karkow et al. | |
| 2016/0025333 | A1 | 1/2016 | Karkow et al. | |
| 2016/0025374 | A1 | 1/2016 | Karkow et al. | |
| 2016/0025380 | A1 | 1/2016 | Karkow et al. | |
| 2016/0046524 | A1 | 2/2016 | Colannino et al. | |
| 2016/0091200 | A1 | 3/2016 | Colannino et al. | |
| 2016/0230984 | A1 | 8/2016 | Colannino et al. | |

FOREIGN PATENT DOCUMENTS

| | | |
|---|---|---|
| WO | WO 2013/181569 | 12/2013 |
| WO | WO 2015/042615 | 3/2015 |
| WO | WO 2015/054323 | 4/2015 |
| WO | WO 2015/061760 | 4/2015 |
| WO | WO 2015/070188 | 5/2015 |
| WO | WO 2015/112950 | 7/2015 |
| WO | WO 2015/123149 | 8/2015 |
| WO | WO 2015/123381 | 8/2015 |
| WO | WO 2015/123683 | 8/2015 |
| WO | WO 2015/123694 | 8/2015 |
| WO | WO 2015/123696 | 8/2015 |
| WO | WO 2015/123701 | 8/2015 |
| WO | WO 2016/007564 | 1/2016 |
| WO | WO 2016/105489 | 6/2016 |

OTHER PUBLICATIONS

PCT International Search Report and Written Opinion of PCT Application No. PCT/US2015/016152 dated May 22, 2015.

PCT International Search Report and Written Opinion of PCT Application No. PCT/US2014/016632 dated May 26, 2014.

PCT International Search Report and Written Opinion of PCT Application No. PCT/US2014/016628 dated May 27, 2014.

PCT International Search Report and Written Opinion of PCT Application No. PCT/US2015/012843 dated May 7, 2015.

Howell, J.R., et al.; "Combustion of Hydrocarbon Fuels Within Porous Inert Media," Dept. of Mechanical Engineering, The University of Texas at Austin. Prog. Energy Combust. Sci., 1996, vol. 22, p. 121-145.

* cited by examiner

HIGH OUTPUT POROUS TILE BURNER

CROSS REFERENCE TO RELATED APPLICATIONS

The present application is a U.S. Continuation-in-Part Application which claims priority benefit under 35 U.S.C. § 120 (pre-AIA) of co-pending International Patent Application No. PCT/US2015/016152, entitled "HIGH OUTPUT POROUS TILE BURNER," filed Feb. 17, 2015. Co-pending International Patent Application No. PCT/US2015/016152 claims priority to International Application No. PCT/US2014/016632, entitled "FUEL COMBUSTION SYSTEM WITH A PERFORATED REACTION HOLDER," filed Feb. 14, 2014. The present application is also a Continuation-in-Part of co-pending U.S. patent application Ser. No. 14/763,271, entitled "PERFORATED FLAME HOLDER AND BURNER INCLUDING A PERFORATED FLAME HOLDER," filed Jul. 24, 2015. Co-pending U.S. patent application Ser. No. 14/763,271 claims priority benefit to International Patent Application No. PCT/US2014/016628, entitled "PERFORATED FLAME HOLDER AND BURNER INCLUDING A PERFORATED FLAME HOLDER," filed Feb. 14, 2014. International Patent Application No. PCT/US2014/016628 claims the benefit of U.S. Provisional Patent Application No. 61/765,022, entitled "PERFORATED FLAME HOLDER AND BURNER INCLUDING A PERFORATED FLAME HOLDER," filed Feb. 14, 2013. The present application is also a Continuation-in-Part of co-pending U.S. patent application Ser. No. 15/215,401, entitled "LOW $NO_X$ FIRE TUBE BOILER," filed Jul. 20, 2016. Co-pending U.S. patent application Ser. No. 15/215,401 claims priority benefit to International Patent Application No. PCT/US2015/012843, entitled "LOW $NO_X$ FIRE TUBE BOILER," filed Jan. 26, 2015. International Patent Application No. PCT/US2015/012843 claims the benefit of U.S. Provisional Patent Application No. 61/931,407, entitled "LOW $NO_X$ FIRE TUBE BOILER," filed Jan. 24, 2014. Each of the international patent applications, U.S. patent applications, and U.S. provisional patent applications listed in this paragraph are, to the extent not inconsistent with the disclosure herein, incorporated by reference.

BACKGROUND

Ceramic tile burners having some degree of porosity can be used as flame holders and radiant heat sources in a variety of applications. Typically, a fuel stream including a fuel component and an oxidant component is introduced at an input face of a ceramic tile burner, where the fuel stream passes into channels or pores of the ceramic tile.

The prior art teaches that, depending upon the surface heat loading of the ceramic tile burner, the fuel stream may begin combusting while inside the porous tile, or may combust as it passes out of an output face of the porous tile. For example, U.S. Pat. No. 4,919,605, to Sarkisian, explains that at low surface heat loads, ceramic tiles act as radiant burners. Combustion of gaseous reactants . . . takes place within the ceramic tile, and the tile becomes radiant. Ignition of the incoming reactants is caused by the high temperature of the ceramic [tile]."

Increasing the surface heat loading results in increased velocity of the fuel stream. According to Sarkisian, at moderate surface heat loading rates, combustion takes place at or above the ceramic tile and the tile is cooled by the incoming reactants. In this regime, the ceramic tile acts as a . . . thermal barrier, and flame holder. Segments between the pores of the tiles cause turbulent recirculation zones to form, and this recirculation of hot gases ignites the combustion reactants as they exit the tile . . . . Increasing the surface heat loading . . . of a ceramic tile burner . . . produces very high velocity reactant flow when low porosity tiles are used . . . . With high porosity ceramic tiles, channel wall thicknesses are small. This has a detrimental effect on the formation of downstream recirculation zones. For this reason, the flame holding capabilities of the tiles are poor, resulting in unstable combustion."

Thus, Sarkisian proposes a tile burner with a wire mesh positioned over the output face to act as a flame holder. Using this arrangement with a tile burner having a porosity of 70%, Sarkisian reports surface loading rates as high as 6500 BTU/H/in$^2$ (0.94 MBTU/H/ft$^2$).

DETAILED DESCRIPTION

Figure 1:
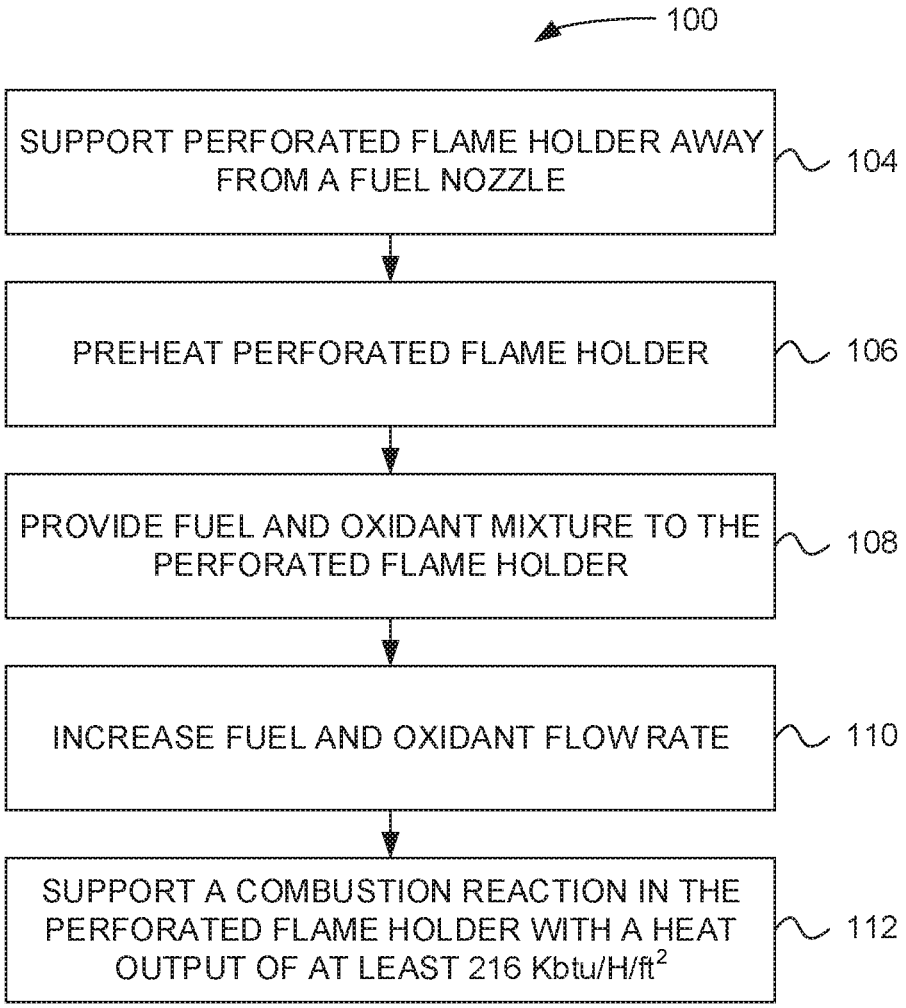
FIG. 1 is a flow chart showing a method for operating a burner including a perforated flame holder, according to an embodiment.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

Various units and unit symbols are used herein in accordance with accepted convention to refer to corresponding values. The double-prime symbol (") is used to denote a length or distance, in inches. Inches and feet may also be abbreviated as "in" and "ft," respectively. "BTU/H" indicates a value in British thermal units per hour. Thus, "BTU/H/ft$^2$" indicates a value of British thermal units per hour, per square foot. "W/cm$^2$" indicates watts per square centimeter. (BTU/H≈W×3.412, in=cm×2.54). 1 W/cm$^2$ is approximately equal to 22 BTU/H/in$^2$. Any value for which the unit symbol is preceded by "k" (kilo) or "M" (mega) is to be multiplied by $1\times10^3$ or $1\times10^6$, respectively. The letters "C" and "F" are used to denote temperature in, respectively, degrees Celsius and degrees Fahrenheit (F=C×9/5+32).

FIG. 1 is a flow chart showing a method 100 for operating a burner including a perforated flame holder (e.g., see FIGS. 2-3, 102), according to an embodiment. Beginning with step 104, a perforated flame holder is supported in a combustion volume away from a fuel nozzle at a dilution distance ($D_D$), describe below. In step 106, the perforated flame holder is preheated to an operating temperature. After the perforated flame holder is preheated, a fuel and oxidant mixture is provided to the perforated flame holder, as shown step 108. The fuel and oxidant combusts and may further heat the perforated flame holder. The initial combustion rate may optionally be low-to-moderate but not high.

Figure 2:
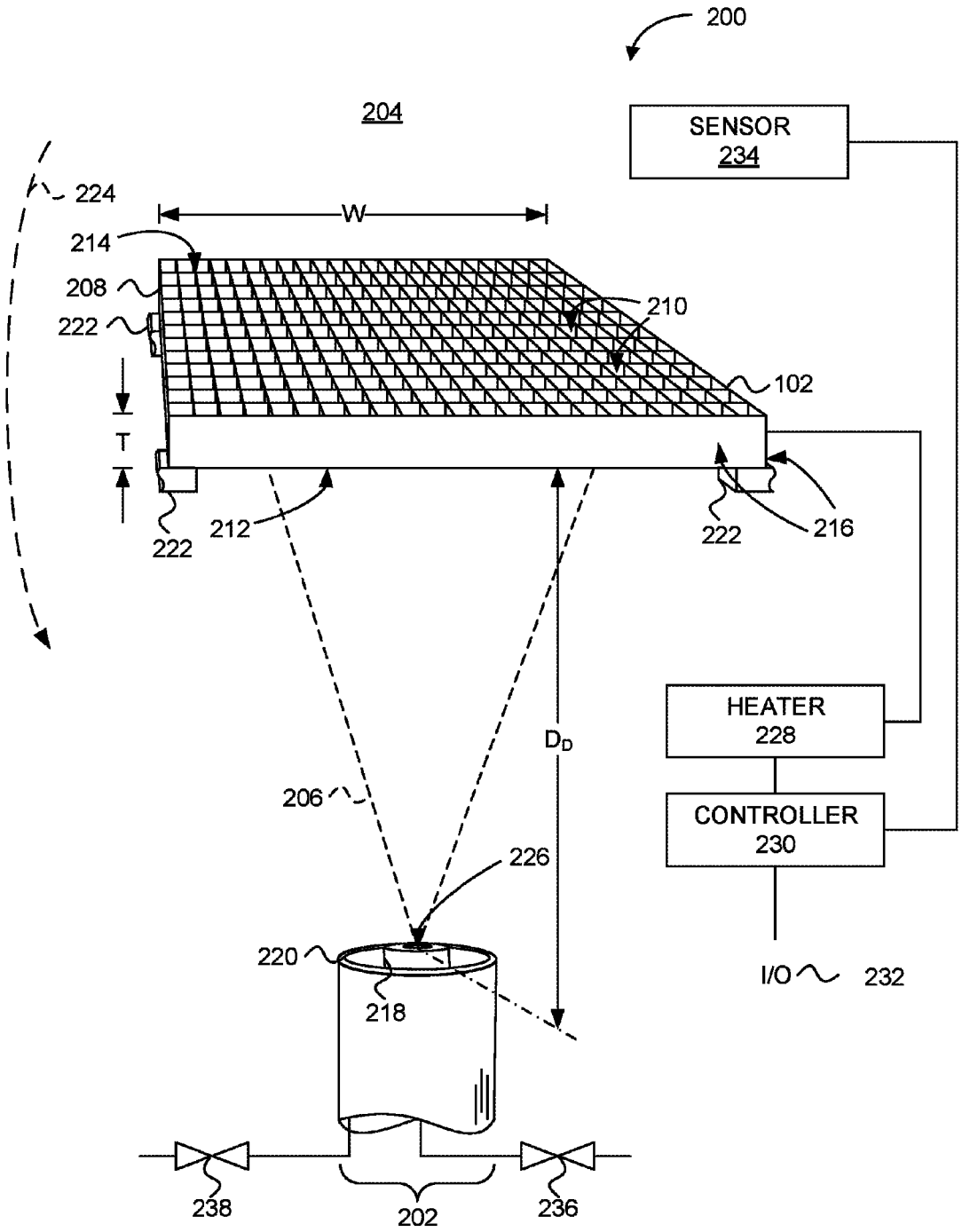
FIG. 2 is a simplified perspective view of a burner system including a perforated flame holder, according to an embodiment.

Proceeding to step 110, the rate of flow of the fuel and oxidant mixture is increased to a desired heat output level. As shown in step 112, the perforated flame holder will support a combustion reaction having a heat output of at least 216 thousand BTU per hour per square foot. As shown in FIG. 2 below, the perforated flame holder 102 has an input face 212 and an output face 214. The area of the output face 214 (and/or the input face 212) is the area referred to in the heat output rates described herein. While the fuel flow initially provided to the perforated flame holder in step 108 may be relatively low, the inventors have discovered that during a start-up procedure, the fuel flow rate can be increased, and the perforated flame holder 102 will reliably support combustion at a high fuel and oxidant mixture flow rate with combustion heat output rates of equal to or greater than 1 million BTU per hour per square foot of output face area of the perforated flame holder.

FIG. 2 is a simplified diagram of a burner system 200 including a perforated flame holder 102 configured to hold a combustion reaction, according to an embodiment. As used herein, the terms perforated flame holder, perforated reaction holder, porous flame holder, porous reaction holder, duplex, and duplex tile shall be considered synonymous unless further definition is provided.

Experiments performed by the inventors have shown that perforated flame holders 102 described herein can support very clean combustion. Specifically, in experimental use of systems 200 ranging from pilot scale to full scale, output of oxides of nitrogen (NOx) was measured to range from low single digit parts per million (ppm) down to undetectable (less than 1 ppm) concentration of NOx at the stack. These remarkable results were measured at 3% (dry) oxygen ($O_2$) concentration with undetectable carbon monoxide (CO) at stack temperatures typical of industrial furnace applications (1400-1600° F.). Moreover, these results did not require any extraordinary measures such as selective catalytic reduction (SCR), selective non-catalytic reduction (SNCR), water/steam injection, external flue gas recirculation (FGR), or other heroic extremes that may be required for conventional burners to even approach such clean combustion.

According to embodiments, the burner system 200 includes a fuel and oxidant source 202 disposed to output fuel and oxidant into a combustion volume 204 to form a fuel and oxidant mixture 206. As used herein, the terms fuel and oxidant mixture and fuel stream may be used interchangeably and considered synonymous depending on the context, unless further definition is provided. As used herein, the terms combustion volume, combustion chamber, furnace volume, and the like shall be considered synonymous unless further definition is provided. The perforated flame holder 102 is disposed in the combustion volume 204 and positioned to receive the fuel and oxidant mixture 206.

Figure 3:
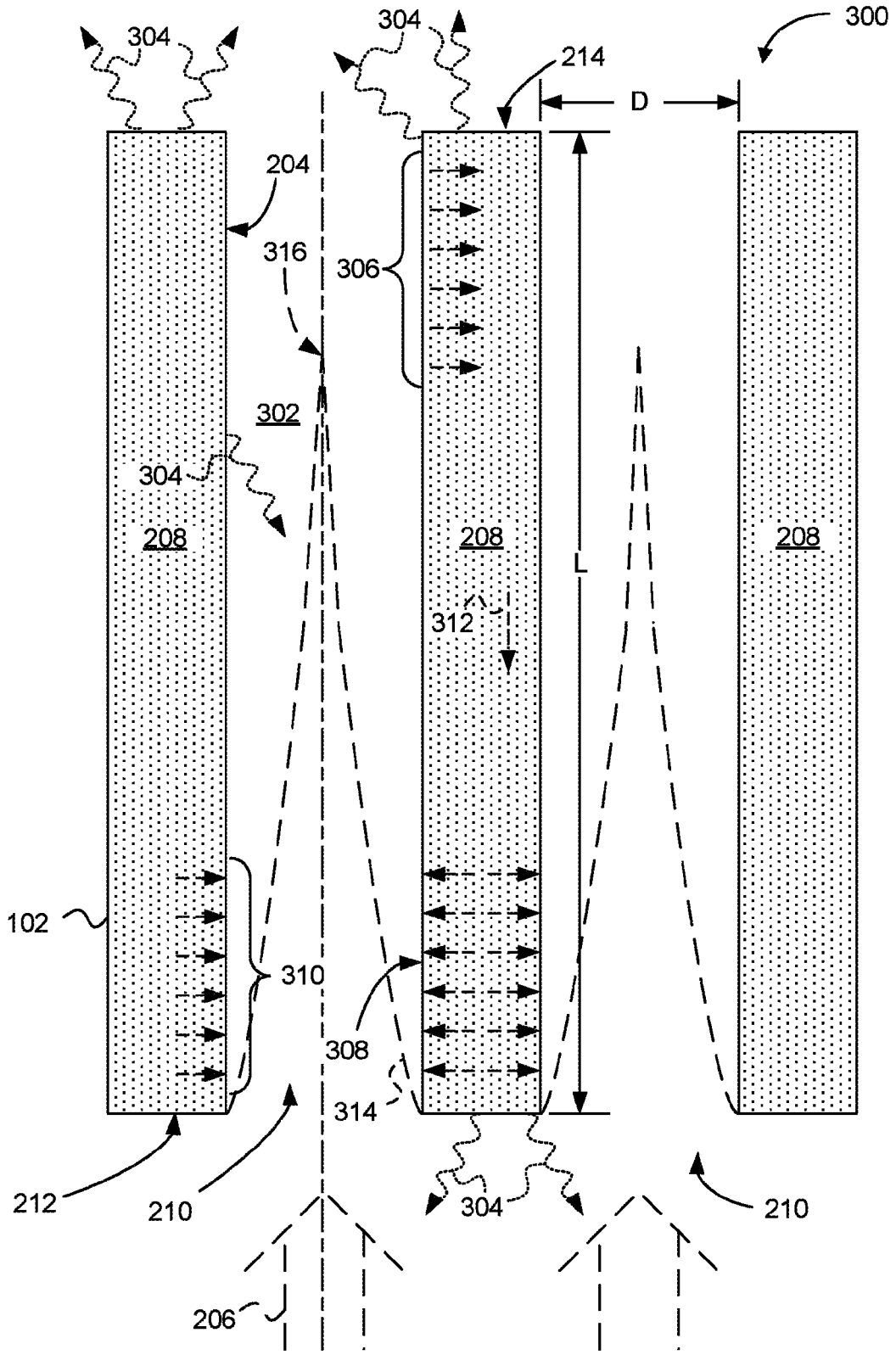
FIG. 3 is a side sectional diagram of a portion of the perforated flame holder of FIG. 2, according to an embodiment.

FIG. 3 is a side sectional diagram 300 of a portion of the perforated flame holder 102 of FIGS. 1 and 2, according to an embodiment. Referring to FIGS. 2 and 3, the perforated flame holder 102 includes a perforated flame holder body 208 defining a plurality of perforations 210 aligned to receive the fuel and oxidant mixture 206 from the fuel and oxidant source 202. As used herein, the terms perforation, pore, aperture, elongated aperture, and the like, in the context of the perforated flame holder 102, shall be considered synonymous unless further definition is provided. The perforations 210 are configured to collectively hold a combustion reaction 302 supported by the fuel and oxidant mixture 206.

The fuel can include hydrogen, a hydrocarbon gas, a vaporized hydrocarbon liquid, an atomized hydrocarbon liquid, or a powdered or pulverized solid. The fuel can be a single species or can include a mixture of gas(es), vapor(s), atomized liquid(s), and/or pulverized solid(s). For example, in a process heater application the fuel can include fuel gas or byproducts from the process that include carbon monoxide (CO), hydrogen ($H_2$), and methane ($CH_4$). In another application the fuel can include natural gas (mostly $CH_4$) or propane ($C_3H_8$). In another application, the fuel can include #2 fuel oil or #6 fuel oil. Dual fuel applications and flexible fuel applications are similarly contemplated by the inventors. The oxidant can include oxygen carried by air, flue gas, and/or can include another oxidant, either pure or carried by a carrier gas. The terms oxidant and oxidizer shall be considered synonymous herein.

According to an embodiment, the perforated flame holder body 208 can be bounded by an input face 212 disposed to receive the fuel and oxidant mixture 206, an output face 214 facing away from the fuel and oxidant source 202, and a peripheral surface 216 defining a lateral extent of the perforated flame holder 102. The plurality of perforations 210 which are defined by the perforated flame holder body 208 extend from the input face 212 to the output face 214. The plurality of perforations 210 can receive the fuel and oxidant mixture 206 at the input face 212. The fuel and oxidant mixture 206 can then combust in or near the plurality of perforations 210 and combustion products can exit the plurality of perforations 210 at or near the output face 214.

According to an embodiment, the perforated flame holder 102 is configured to hold a majority of the combustion reaction 302 within the perforations 210. For example, on a steady-state basis, more than half the molecules of fuel output into the combustion volume 204 by the fuel and oxidant source 202 may be converted to combustion products between the input face 212 and the output face 214 of the perforated flame holder 102. According to an alternative interpretation, more than half of the heat or thermal energy output by the combustion reaction 302 may be output between the input face 212 and the output face 214 of the perforated flame holder 102. As used herein, the terms heat, heat energy, and thermal energy shall be considered synonymous unless further definition is provided. As used above, heat energy and thermal energy refer generally to the released chemical energy initially held by reactants during the combustion reaction 302. As used elsewhere herein, heat, heat energy and thermal energy correspond to a detectable temperature rise undergone by real bodies characterized by heat capacities. Under nominal operating conditions, the perforations 210 can be configured to collectively hold at least 80% of the combustion reaction 302 between the input face 212 and the output face 214 of the perforated flame holder 102. In some experiments, the inventors produced a combustion reaction 302 that was apparently wholly contained in the perforations 210 between the input face 212 and the output face 214 of the perforated flame holder 102. According to an alternative interpretation, the perforated flame holder 102 can support combustion between the input face 212 and output face 214 when combustion is "time-averaged." For example, during transients, such as before the perforated flame holder 102 is fully heated, or if too high a (cooling) load is placed on the system, the combustion may travel somewhat downstream from the output face 214 of the perforated flame holder 102. Alternatively, if the cooling load is relatively low and/or the furnace temperature reaches a high level, the combustion may travel somewhat upstream of the input face 212 of the perforated flame holder 102.

While a "flame" is described in a manner intended for ease of description, it should be understood that in some instances, no visible flame is present. Combustion occurs primarily within the perforations 210, but the "glow" of combustion heat is dominated by a visible glow of the perforated flame holder 102 itself. In other instances, the inventors have noted transient "huffing" or "flashback" wherein a visible flame momentarily ignites in a region lying between the input face 212 of the perforated flame holder 102 and the fuel nozzle 218, within the dilution region $D_D$. Such transient huffing or flashback is generally short in duration such that, on a time-averaged basis, a majority of combustion occurs within the perforations 210 of the perforated flame holder 102, between the input face 212 and the output face 214. In still other instances, the inventors have noted apparent combustion occurring downstream from the output face 214 of the perforated flame holder 102, but still a majority of combustion occurred within the perforated flame holder 102 as evidenced by continued visible glow from the perforated flame holder 102 that was observed.

The perforated flame holder 102 can be configured to receive heat from the combustion reaction 302 and output a portion of the received heat as thermal radiation 304 to heat-receiving structures (e.g., furnace walls and/or radiant section working fluid tubes) in or adjacent to the combustion volume 204. As used herein, terms such as radiation, thermal radiation, radiant heat, heat radiation, etc. are to be construed as being substantially synonymous, unless further definition is provided. Specifically, such terms refer to blackbody-type radiation of electromagnetic energy, primarily at infrared wavelengths, but also at visible wavelengths owing to elevated temperature of the perforated flame holder body 208.

Referring especially to FIG. 3, the perforated flame holder 102 outputs another portion of the received heat to the fuel and oxidant mixture 206 received at the input face 212 of the perforated flame holder 102. The perforated flame holder body 208 may receive heat from the combustion reaction 302 at least in heat receiving regions 306 of perforation walls 308. Experimental evidence has suggested to the inventors that the position of the heat receiving regions 306, or at least the position corresponding to a maximum rate of receipt of heat, can vary along the length of the perforation walls 308. In some experiments, the location of maximum receipt of heat was apparently between ⅓ and ½ of the distance from the input face 212 to the output face 214 (i.e., somewhat nearer to the input face 212 than to the output face 214). The inventors contemplate that the heat receiving regions 306 may lie nearer to the output face 214 of the perforated flame holder 102 under other conditions. Most probably, there is no clearly defined edge of the heat receiving regions 306 (or for that matter, the heat output regions 310, described below). For ease of understanding, the heat receiving regions 306 and the heat output regions 310 will be described as particular regions 306, 310.

The perforated flame holder body 208 can be characterized by a heat capacity. The perforated flame holder body 208 may hold thermal energy from the combustion reaction 302 in an amount corresponding to the heat capacity multiplied by temperature rise, and transfer the thermal energy from the heat receiving regions 306 to heat output regions 310 of the perforation walls 308. Generally, the heat output regions 310 are nearer to the input face 212 than are the heat receiving regions 306. According to one interpretation, the perforated flame holder body 208 can transfer heat from the heat receiving regions 306 to the heat output regions 310 via thermal radiation, depicted graphically as 304. According to another interpretation, the perforated flame holder body 208 can transfer heat from the heat receiving regions 306 to the heat output regions 310 via heat conduction along heat conduction paths 312. The inventors contemplate that multiple heat transfer mechanisms including conduction, radiation, and possibly convection may be operative in transferring heat from the heat receiving regions 306 to the heat output regions 310. In this way, the perforated flame holder 102 may act as a heat source to maintain the combustion reaction 302, even under conditions where a combustion reaction 302 would not be stable when supported from a conventional flame holder.

The inventors believe that the perforated flame holder 102 causes the combustion reaction 302 to begin within thermal boundary layers 314 formed adjacent to walls 308 of the perforations 210. Insofar as combustion is generally understood to include a large number of individual reactions, and since a large portion of combustion energy is released within the perforated flame holder 102, it is apparent that at least a majority of the individual reactions occur within the perforated flame holder 102. As the relatively cool fuel and oxidant mixture 206 approaches the input face 212, the flow is split into portions that respectively travel through individual perforations 210. The hot perforated flame holder body 208 transfers heat to the fluid, notably within thermal boundary layers 314 that progressively thicken as more and more heat is transferred to the incoming fuel and oxidant mixture 206. After reaching a combustion temperature (e.g., the auto-ignition temperature of the fuel), the reactants continue to flow while a chemical ignition delay time elapses, over which time the combustion reaction 302 occurs. Accordingly, the combustion reaction 302 is shown as occurring within the thermal boundary layers 314. As flow progresses, the thermal boundary layers 314 merge at a merger point 316. Ideally, the merger point 316 lies between the input face 212 and output face 214 that define the ends of the perforations 210. At some position along the length of a perforation 210, the combustion reaction 302 outputs more heat to the perforated flame holder body 208 than it receives from the perforated flame holder body 208. The heat is received at the heat receiving region 306, is held by the perforated flame holder body 208, and is transported to the heat output region 310 nearer to the input face 212, where the heat is transferred into the cool reactants (and any included diluent) to bring the reactants to the ignition temperature.

In an embodiment, each of the perforations 210 is characterized by a length L defined as a reaction fluid propagation path length between the input face 212 and the output face 214 of the perforated flame holder 102. As used herein, the term reaction fluid refers to matter that travels through a perforation 210. Near the input face 212, the reaction fluid includes the fuel and oxidant mixture 206 (optionally including nitrogen, flue gas, and/or other "non-reactive" species). Within the combustion reaction region, the reaction fluid may include plasma associated with the combustion reaction 302, molecules of reactants and their constituent parts, any non-reactive species, reaction intermediates (including transition states), and reaction products. Near the output face 214, the reaction fluid may include reaction products and byproducts, non-reactive gas, and excess oxidant.

The plurality of perforations 210 can be each characterized by a transverse dimension D between opposing perforation walls 308. The inventors have found that stable combustion can be maintained in the perforated flame holder 102 if the length L of each perforation 210 is at least four times the transverse dimension D of the perforation. In other embodiments, the length L can be greater than six times the transverse dimension D. For example, experiments have been run where L is at least eight, at least twelve, at least sixteen, and at least twenty-four times the transverse dimension D. Preferably, the length L is sufficiently long for thermal boundary layers 314 to form adjacent to the perforation walls 308 in a reaction fluid flowing through the perforations 210 to converge at merger points 316 within the perforations 210 between the input face 212 and the output face 214 of the perforated flame holder 102. In experiments, the inventors have found L/D ratios between 12 and 48 to work well (i.e., produce low NOx, produce low CO, and maintain stable combustion).

The perforated flame holder body 208 can be configured to convey heat between adjacent perforations 210. The heat conveyed between adjacent perforations 210 can be selected to cause heat output from the combustion reaction portion 302 in a first perforation 210 to supply heat to stabilize a combustion reaction portion 302 in an adjacent perforation 210.

Referring especially to FIG. 2, the fuel and oxidant source 202 can further include a fuel nozzle 218, configured to output fuel, and an oxidant source 220 configured to output a fluid including the oxidant. For example, the fuel nozzle 218 can be configured to output pure fuel. The oxidant source 220 can be configured to output combustion air carrying oxygen, and optionally, flue gas.

The perforated flame holder 102 can be held by a perforated flame holder support structure 222 configured to hold the perforated flame holder 102 at a dilution distance $D_D$ away from the fuel nozzle 218. The fuel nozzle 218 can be configured to emit a fuel jet selected to entrain the oxidant to form the fuel and oxidant mixture 206 as the fuel jet and oxidant travel along a path to the perforated flame holder 102 through the dilution distance $D_D$ between the fuel nozzle 218 and the perforated flame holder 102. Additionally or alternatively (particularly when a blower is used to deliver oxidant contained in combustion air), the oxidant or combustion air source can be configured to entrain the fuel and the fuel and oxidant travel through the dilution distance $D_D$. In some embodiments, a flue gas recirculation path 224 can be provided. Additionally or alternatively, the fuel nozzle 218 can be configured to emit a fuel jet selected to entrain the oxidant and to entrain flue gas as the fuel jet travels through the dilution distance $D_D$ between the fuel nozzle 218 and the input face 212 of the perforated flame holder 102.

The fuel nozzle 218 can be configured to emit the fuel through one or more fuel orifices 226 having an inside diameter dimension that is referred to as "nozzle diameter." The perforated flame holder support structure 222 can support the perforated flame holder 102 to receive the fuel and oxidant mixture 206 at the distance $D_D$ away from the fuel nozzle 218 greater than 20 times the nozzle diameter. In another embodiment, the perforated flame holder 102 is disposed to receive the fuel and oxidant mixture 206 at the distance $D_D$ away from the fuel nozzle 218 between 100 times and 1100 times the nozzle diameter. Preferably, the perforated flame holder support structure 222 is configured to hold the perforated flame holder 102 at a distance about 200 times or more of the nozzle diameter away from the fuel nozzle 218. When the fuel and oxidant mixture 206 travels about 200 times the nozzle diameter or more, the mixture is sufficiently homogenized to cause the combustion reaction 302 to produce minimal NOx.

The fuel and oxidant source 202 can alternatively include a premix fuel and oxidant source, according to an embodiment. A premix fuel and oxidant source can include a premix chamber (not shown), a fuel nozzle configured to output fuel into the premix chamber, and an oxidant (e.g., combustion air) channel configured to output the oxidant into the premix chamber. A flame arrestor can be disposed between the premix fuel and oxidant source and the perforated flame holder 102 and be configured to prevent flame flashback into the premix fuel and oxidant source.

The oxidant source 220, whether configured for entrainment in the combustion volume 204 or for premixing, can include a blower configured to force the oxidant through the fuel and oxidant source 202.

The support structure 222 can be configured to support the perforated flame holder 102 from a floor or wall (not shown) of the combustion volume 204, for example. In another embodiment, the support structure 222 supports the perforated flame holder 102 from the fuel and oxidant source 202. Alternatively, the support structure 222 can suspend the perforated flame holder 102 from an overhead structure (such as a flue, in the case of an up-fired system). The support structure 222 can support the perforated flame holder 102 in various orientations and directions.

The perforated flame holder 102 can include a single perforated flame holder body 208. In another embodiment, the perforated flame holder 102 can include a plurality of adjacent perforated flame holder sections that collectively provide a tiled perforated flame holder 102.

The perforated flame holder support structure 222 can be configured to support the plurality of perforated flame holder sections. The perforated flame holder support structure 222 can include a metal superalloy, a cementatious, and/or ceramic refractory material. In an embodiment, the plurality of adjacent perforated flame holder sections can be joined with a fiber reinforced refractory cement.

The perforated flame holder 102 can have a width dimension W between opposite sides of the peripheral surface 216 at least twice a thickness dimension T between the input face 212 and the output face 214. In another embodiment, the perforated flame holder 102 can have a width dimension W between opposite sides of the peripheral surface 216 at least three times, at least six times, or at least nine times the thickness dimension T between the input face 212 and the output face 214 of the perforated flame holder 102.

In an embodiment, the perforated flame holder 102 can have a width dimension W less than a width of the combustion volume 204. This can allow the flue gas circulation path 224 from above to below the perforated flame holder 102 to lie between the peripheral surface 216 of the perforated flame holder 102 and the combustion volume wall (not shown).

Referring again to both FIGS. 2 and 3, the perforations 210 can be of various shapes. In an embodiment, the perforations 210 can include elongated squares, each having a transverse dimension D between opposing sides of the squares. In another embodiment, the perforations 210 can include elongated hexagons, each having a transverse dimension D between opposing sides of the hexagons. In yet another embodiment, the perforations 210 can include hollow cylinders, each having a transverse dimension D corresponding to a diameter of the cylinder. In another embodiment, the perforations 210 can include truncated cones or truncated pyramids (e.g., frustums), each having a transverse dimension D radially symmetric relative to a length axis that extends from the input face 212 to the output face 214. In some embodiments, the perforations 210 can each have a lateral dimension D equal to or greater than a quenching distance of the flame based on standard reference conditions. Alternatively, the perforations 210 may have lateral dimension D less then than a standard reference quenching distance.

In one range of embodiments, each of the plurality of perforations 210 has a lateral dimension D between 0.05 inch and 1.0 inch. Preferably, each of the plurality of perforations 210 has a lateral dimension D between 0.1 inch and 0.5 inch. For example the plurality of perforations 210 can each have a lateral dimension D of about 0.2 to 0.4 inch.

The void fraction of a perforated flame holder 102 is defined as the total volume of all perforations 210 in a section of the perforated flame holder 102 divided by a total volume of the perforated flame holder 102 including body 208 and perforations 210. The perforated flame holder 102 should have a void fraction between 0.10 and 0.90. In an embodiment, the perforated flame holder 102 can have a void fraction between 0.30 and 0.80. In another embodiment, the perforated flame holder 102 can have a void fraction of about 0.70. Using a void fraction of about 0.70 was found to be especially effective for producing very low NOx.

The perforated flame holder 102 can be formed from a fiber reinforced cast refractory material and/or a refractory material such as an aluminum silicate material. For example, the perforated flame holder 102 can be formed to include mullite or cordierite. Additionally or alternatively, the perforated flame holder body 208 can include a metal superalloy such as Inconel or Hastelloy. The perforated flame holder body 208 can define a honeycomb. Honeycomb is an industrial term of art that need not strictly refer to a hexagonal cross section and most usually includes cells of square cross section. Honeycombs of other cross sectional areas are also known.

The inventors have found that the perforated flame holder 102 can be formed from VERSAGRID® ceramic honeycomb, available from Applied Ceramics, Inc. of Doraville, S.C.

The perforations 210 can be parallel to one another and normal to the input and output faces 212, 214. In another embodiment, the perforations 210 can be parallel to one another and formed at an angle relative to the input and output faces 212, 214. In another embodiment, the perforations 210 can be non-parallel to one another. In another embodiment, the perforations 210 can be non-parallel to one another and non-intersecting. In another embodiment, the perforations 210 can be intersecting. The body 308 can be one piece or can be formed from a plurality of sections.

In another embodiment, which is not necessarily preferred, the perforated flame holder 102 may be formed from reticulated ceramic material. The term "reticulated" refers to a netlike structure. Reticulated ceramic material is often made by dissolving a slurry into a sponge of specified porosity, allowing the slurry to harden, and burning away the sponge and curing the ceramic.

In another embodiment, which is not necessarily preferred, the perforated flame holder 102 may be formed from a ceramic material that has been punched, bored or cast to create channels.

In another embodiment, the perforated flame holder 102 can include a plurality of tubes or pipes bundled together. The plurality of perforations 210 can include hollow cylinders and can optionally also include interstitial spaces between the bundled tubes. In an embodiment, the plurality of tubes can include ceramic tubes. Refractory cement can be included between the tubes and configured to adhere the tubes together. In another embodiment, the plurality of tubes can include metal (e.g., superalloy) tubes. The plurality of tubes can be held together by a metal tension member circumferential to the plurality of tubes and arranged to hold the plurality of tubes together. The metal tension member can include stainless steel, a superalloy metal wire, and/or a superalloy metal band.

The perforated flame holder body 208 can alternatively include stacked perforated sheets of material, each sheet having openings that connect with openings of subjacent and superjacent sheets. The perforated sheets can include perforated metal sheets, ceramic sheets and/or expanded sheets. In another embodiment, the perforated flame holder body 208 can include discontinuous packing bodies such that the perforations 210 are formed in the interstitial spaces between the discontinuous packing bodies. In one example, the discontinuous packing bodies include structured packing shapes. In another example, the discontinuous packing bodies include random packing shapes. For example, the discontinuous packing bodies can include ceramic Raschig ring, ceramic Berl saddles, ceramic Intalox saddles, and/or metal rings or other shapes (e.g. Super Raschig Rings) that may be held together by a metal cage.

The inventors contemplate various explanations for why burner systems including the perforated flame holder 102 provide such clean combustion.

According to an embodiment, the perforated flame holder 102 may act as a heat source to maintain a combustion reaction even under conditions where a combustion reaction would not be stable when supported by a conventional flame holder. This capability can be leveraged to support combustion using a leaner fuel-to-oxidant mixture than is typically feasible. Thus, according to an embodiment, at the point where the fuel stream 206 contacts the input face 212 of the perforated flame holder 102, an average fuel-to-oxidant ratio of the fuel stream 206 is below a (conventional) lower combustion limit of the fuel component of the fuel stream 206—lower combustion limit defines the lowest concentration of fuel at which a fuel and oxidant mixture 206 will burn when exposed to a momentary ignition source under normal atmospheric pressure and an ambient temperature of 25° C. (77° F.).

The perforated flame holder 102 and systems including the perforated flame holder 102 described herein were found to provide substantially complete combustion of CO (single digit ppm down to undetectable, depending on experimental conditions), while supporting low NOx. According to one interpretation, such a performance can be achieved due to a sufficient mixing used to lower peak flame temperatures (among other strategies). Flame temperatures tend to peak under slightly rich conditions, which can be evident in any diffusion flame that is insufficiently mixed. By sufficiently mixing, a homogenous and slightly lean mixture can be achieved prior to combustion. This combination can result in reduced flame temperatures, and thus reduced NOx formation. In one embodiment, "slightly lean" may refer to 3% $O_2$, i.e. an equivalence ratio of ~0.87. Use of even leaner mixtures is possible, but may result in elevated levels of $O_2$. Moreover, the inventors believe perforation walls 308 may act as a heat sink for the combustion fluid. This effect may alternatively or additionally reduce combustion temperatures and lower NOx.

According to another interpretation, production of NOx can be reduced if the combustion reaction 302 occurs over a very short duration of time. Rapid combustion causes the reactants (including oxygen and entrained nitrogen) to be exposed to NOx-formation temperature for a time too short for NOx formation kinetics to cause significant production of NOx. The time required for the reactants to pass through the perforated flame holder 102 is very short compared to a conventional flame. The low NOx production associated with perforated flame holder combustion may thus be related to the short duration of time required for the reactants (and entrained nitrogen) to pass through the perforated flame holder 102.

Figure 4:
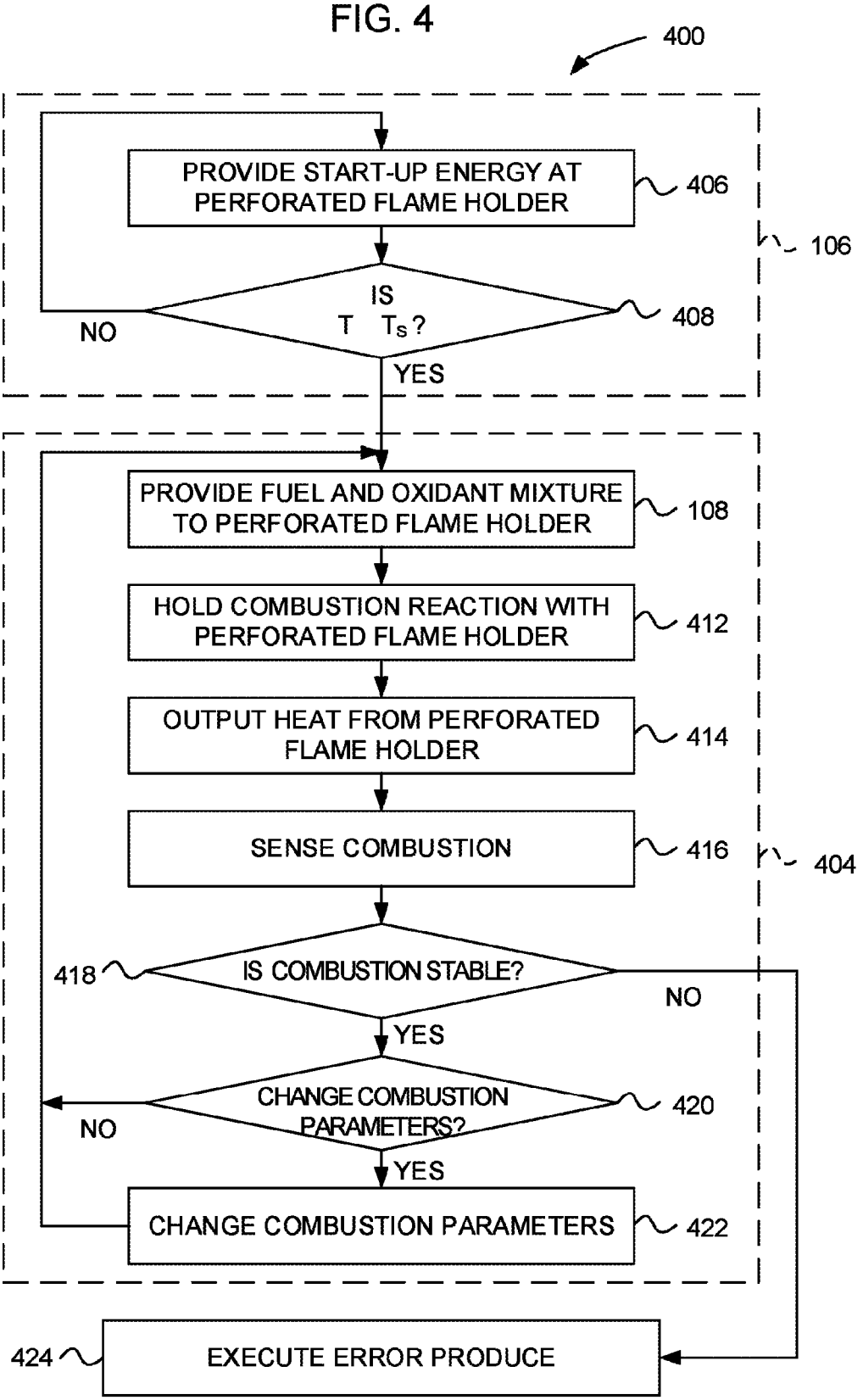
FIG. 4 is a flow chart showing a method for operating a burner system including the perforated flame holder of FIGS. 2 and 3, according to an embodiment.

FIG. 4 is a flow chart showing a method 400 for operating a burner system including the perforated flame holder shown and described herein. To operate a burner system including a perforated flame holder, the perforated flame holder is first heated to a temperature sufficient to maintain combustion of the fuel and oxidant mixture.

According to a simplified description, the method 400 begins with step 106, wherein the perforated flame holder is preheated to a start-up temperature, $T_S$. After the perforated flame holder is raised to the start-up temperature, the method proceeds to step 404, wherein fuel and oxidant are provided to the perforated flame holder and combustion is held by the perforated flame holder.

According to a more detailed description, step 106 begins with step 406, wherein start-up energy is provided at the perforated flame holder. Simultaneously or following providing start-up energy, a decision step 408 determines whether the temperature T of the perforated flame holder is at or above the start-up temperature, $T_S$. As long as the temperature of the perforated flame holder is below its start-up temperature, the method loops between steps 406 and 408 within the preheat step 106. In step 408, if the temperature T of at least a predetermined portion of the perforated flame holder is greater than or equal to the start-up temperature, the method 400 proceeds to overall step 404, wherein fuel and oxidant is supplied to and combustion is held by the perforated flame holder.

Step 404 may be broken down into several discrete steps, at least some of which may occur simultaneously.

Proceeding from step 408, a fuel and oxidant mixture is provided to the perforated flame holder, as shown in step 108. The fuel and oxidant may be provided by a fuel and oxidant source that includes a separate fuel nozzle and combustion air source, for example. In this approach, the fuel and combustion air are output in one or more directions selected to cause the fuel and combustion air mixture to be received by an input face of the perforated flame holder. The fuel may entrain the combustion air (or alternatively, the combustion air may dilute the fuel) to provide a fuel and oxidant mixture at the input face of the perforated flame holder at a fuel dilution selected for a stable combustion reaction that can be held within the perforations of the perforated flame holder.

Proceeding to step 412, the combustion reaction is held by the perforated flame holder.

In step 414, heat may be output from the perforated flame holder. The heat output from the perforated flame holder may be used to power an industrial process, heat a working fluid, generate electricity, or provide motive power, for example.

In optional step 416, the presence of combustion may be sensed. Various sensing approaches have been used and are contemplated by the inventors. Generally, combustion held by the perforated flame holder is very stable and no unusual sensing requirement is placed on the system. Combustion sensing may be performed using an infrared sensor, a video sensor, an ultraviolet sensor, a charged species sensor, thermocouple, thermopile, and/or other known combustion sensing apparatuses. In an additional or alternative variant of step 416, a pilot flame or other ignition source may be provided to cause ignition of the fuel and oxidant mixture in the event combustion is lost at the perforated flame holder.

Proceeding to decision step 418, if combustion is sensed not to be stable, the method 400 may exit to step 424, wherein an error procedure is executed. For example, the error procedure may include turning off fuel flow, re-executing the preheating step 106, outputting an alarm signal, igniting a stand-by combustion system, or other steps. If, in step 418, combustion in the perforated flame holder is determined to be stable, the method 400 proceeds to decision step 420, wherein it is determined if combustion parameters should be changed. If no combustion parameters are to be changed, the method loops (within step 404) back to step 108, and the combustion process continues. If a change in combustion parameters is indicated, the method 400 proceeds to step 422, wherein the combustion parameter change is executed. After changing the combustion parameter(s), the method loops (within step 404) back to step 108, and combustion continues.

Combustion parameters may be scheduled to be changed, for example, if a change in heat demand is encountered. For example, if less heat is required (e.g., due to decreased electricity demand, decreased motive power requirement, or lower industrial process throughput), the fuel and oxidant flow rate may be decreased in step 422. Conversely, if heat demand is increased, then fuel and oxidant flow may be increased. Additionally or alternatively, if the combustion system is in a start-up mode, then fuel and oxidant flow may be gradually increased to the perforated flame holder over one or more iterations of the loop within step 404.

Referring again to FIG. 2, the burner system 200 includes a heater 228 operatively coupled to the perforated flame holder 102. As described in conjunction with FIGS. 3 and 4, the perforated flame holder 102 operates by outputting heat to the incoming fuel and oxidant mixture 206. After combustion is established, this heat is provided by the combustion reaction 302; but before combustion is established, the heat is provided by the heater 228.

Various heating apparatuses have been used and are contemplated by the inventors. In some embodiments, the heater 228 can include a flame holder configured to support a flame disposed to heat the perforated flame holder 102. The fuel and oxidant source 202 can include a fuel nozzle 218 configured to emit a fuel stream 206 and an oxidant source 220 configured to output oxidant (e.g., combustion air) adjacent to the fuel stream 206. The fuel nozzle 218 and oxidant source 220 can be configured to output the fuel stream 206 to be progressively diluted by the oxidant (e.g., combustion air). The perforated flame holder 102 can be disposed to receive a diluted fuel and oxidant mixture 206 that supports a combustion reaction 302 that is stabilized by the perforated flame holder 102 when the perforated flame holder 102 is at an operating temperature. A start-up flame holder, in contrast, can be configured to support a start-up flame at a location corresponding to a relatively unmixed fuel and oxidant mixture that is stable without stabilization provided by the heated perforated flame holder 102.

The burner system 200 can further include a controller 230 operatively coupled to the heater 228 and to a data interface 232. For example, the controller 230 can be configured to control a start-up flame holder actuator configured to cause the start-up flame holder to hold the start-up flame when the perforated flame holder 102 needs to be pre-heated and to not hold the start-up flame when the perforated flame holder 102 is at an operating temperature (e.g., when $T \geq T_S$).

Various approaches for actuating a start-up flame are contemplated. In one embodiment, the start-up flame holder includes a mechanically-actuated bluff body configured to be actuated to intercept the fuel and oxidant mixture 206 to cause heat-recycling and/or stabilizing vortices and thereby hold a start-up flame; or to be actuated to not intercept the fuel and oxidant mixture 206 to cause the fuel and oxidant mixture 206 to proceed to the perforated flame holder 102. In another embodiment, a fuel control valve, blower, and/or damper may be used to select a fuel and oxidant mixture flow rate that is sufficiently low for a start-up flame to be jet-stabilized; and upon reaching a perforated flame holder 102 operating temperature, the flow rate may be increased to "blow out" the start-up flame. In another embodiment, the heater 228 may include an electrical power supply operatively coupled to the controller 230 and configured to apply an electrical charge or voltage to the fuel and oxidant mixture 206. An electrically conductive start-up flame holder may be selectively coupled to a voltage ground or other voltage selected to attract the electrical charge in the fuel and oxidant mixture 206. The attraction of the electrical charge was found by the inventors to cause a start-up flame to be held by the electrically conductive start-up flame holder.

In another embodiment, the heater 228 may include an electrical resistance heater configured to output heat to the perforated flame holder 102 and/or to the fuel and oxidant mixture 206. The electrical resistance heater can be configured to heat up the perforated flame holder 102 to an operating temperature. The heater 228 can further include a power supply and a switch operable, under control of the controller 230, to selectively couple the power supply to the electrical resistance heater.

An electrical resistance heater 228 can be formed in various ways. For example, the electrical resistance heater 228 can be formed from KANTHAL® wire (available from Sandvik Materials Technology division of Sandvik AB of Hallstahammar, Sweden) threaded through at least a portion of the perforations 210 defined by the perforated flame holder body 208. Alternatively, the heater 228 can include an inductive heater, a high-energy beam heater (e.g. microwave or laser), a frictional heater, electro-resistive ceramic coatings, or other types of heating technologies.

Other forms of start-up apparatuses are contemplated. For example, the heater 228 can include an electrical discharge igniter or hot surface igniter configured to output a pulsed ignition to the oxidant and fuel. Additionally or alternatively, a start-up apparatus can include a pilot flame apparatus disposed to ignite the fuel and oxidant mixture 206 that would otherwise enter the perforated flame holder 102. The electrical discharge igniter, hot surface igniter, and/or pilot flame apparatus can be operatively coupled to the controller 230, which can cause the electrical discharge igniter or pilot flame apparatus to maintain combustion of the fuel and oxidant mixture 206 in or upstream from the perforated flame holder 102 before the perforated flame holder 102 is heated sufficiently to maintain combustion.

The burner system 200 can further include a sensor 234 operatively coupled to the control circuit 230. The sensor 234 can include a heat sensor configured to detect infrared radiation or a temperature of the perforated flame holder 102. The control circuit 230 can be configured to control the heating apparatus 228 responsive to input from the sensor 234. Optionally, a fuel control valve 236 can be operatively coupled to the controller 230 and configured to control a flow of fuel to the fuel and oxidant source 202. Additionally or alternatively, an oxidant blower or damper 238 can be operatively coupled to the controller 230 and configured to control flow of the oxidant (or combustion air).

The sensor 234 can further include a combustion sensor operatively coupled to the control circuit 230, the combustion sensor being configured to detect a temperature, video image, and/or spectral characteristic of a combustion reaction held by the perforated flame holder 102. The fuel control valve 236 can be configured to control a flow of fuel from a fuel source to the fuel and oxidant source 202. The controller 230 can be configured to control the fuel control valve 236 responsive to input from the combustion sensor 234. The controller 230 can be configured to control the fuel control valve 236 and/or oxidant blower or damper to control a preheat flame type of heater 228 to heat the perforated flame holder 102 to an operating temperature. The controller 230 can similarly control the fuel control valve 236 and/or the oxidant blower or damper to change the fuel and oxidant mixture 206 flow responsive to a heat demand change received as data via the data interface 232.

Figure 5:
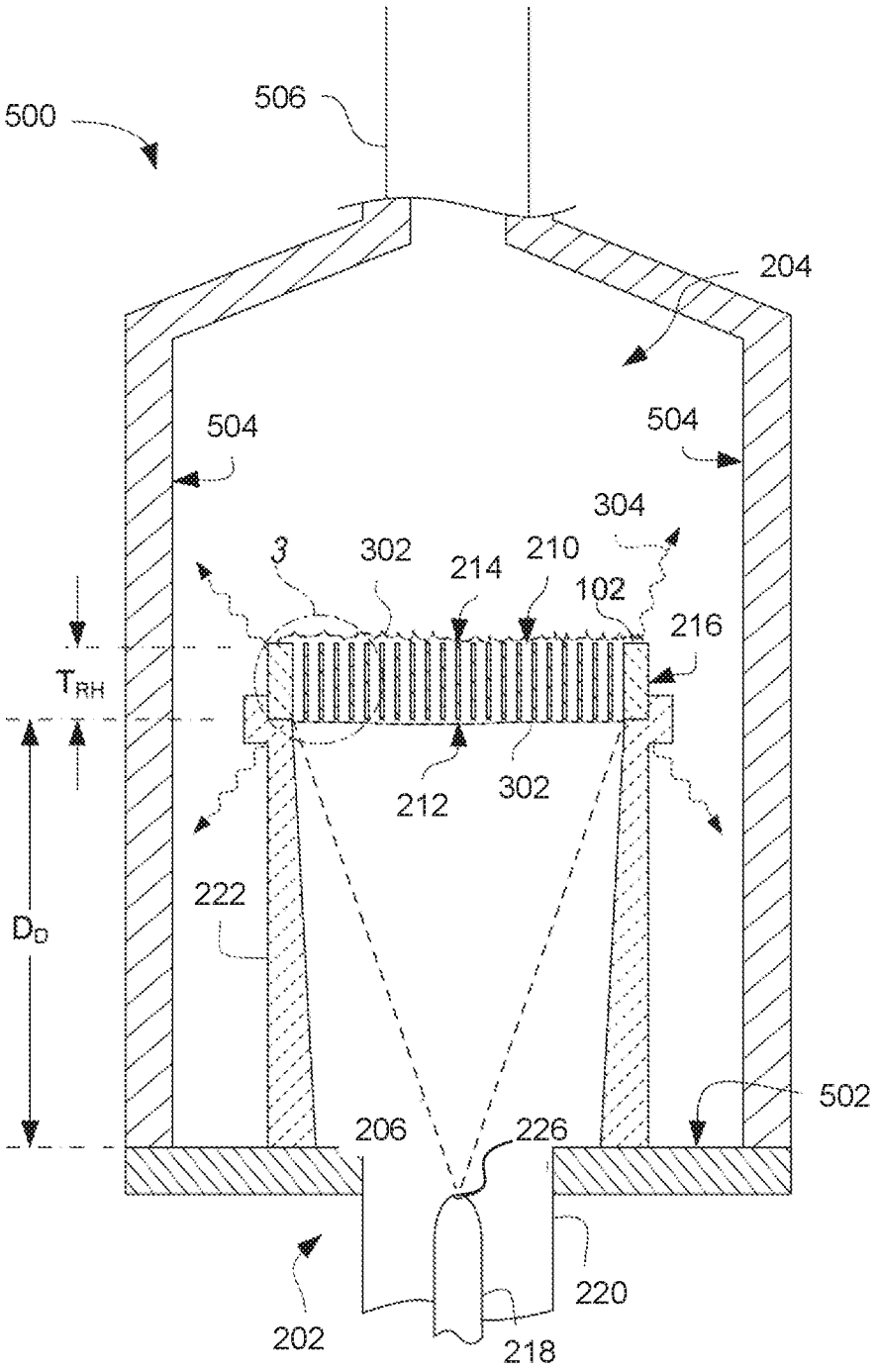
FIG. 5 is a simplified side sectional view of the burner system of FIG. 2, according to an embodiment.

FIG. 5 is a simplified side sectional view of the burner system 500 of FIGS. 2-3, according to an embodiment.

According to an embodiment, the combustion volume 204 is defined by a base surface 502 and inner surfaces 504 of sidewalls substantially enclosing the combustion volume 204 laterally.

As used in the specification and claims, the term fuel stream is to be construed broadly, as reading on a stream of fuel; fuel and oxidant; and/or fuel, oxidant, and diluent. Some or all of the non-fuel components of a fuel stream can be premixed with the fuel or entrained, such as by a stream of fuel as it exits a nozzle 218.

Flue gas is vented to the atmosphere through an exhaust flue 506. Optionally, the vented flue gas can pass through convective heat transfer tubes and/or an economizer that pre-heats the combustion air, the fuel, and/or feed water.

The perforated flame holder 102 is shown in FIG. 2 as being rectangular and as having apertures 210 that are substantially square, as viewed from above. According to other embodiments, the flame holder 102 can have any appropriate shape, including square, round, hexagonal, etc. Likewise, the apertures 210 can have any appropriate shape, including round, square, rectangular, hexagonal, etc., and can be arranged according to any configuration that meets the requirements of the particular application. According to an embodiment, the apertures 210 are arranged in an X-Y grid, as shown in FIG. 2, at a pitch of between 0.1" and 0.5". The walls defining and separating the apertures have a thickness that corresponds to an overall "porosity" of the flame holder 102 of between about 30% and 80%. Thus, for example, according to an embodiment in which the apertures have, in plan view, a square shape and a pitch of 0.25", each aperture has a width of about 0.206", separated by walls having a thickness of about 0.041", yielding a porosity of about 70%.

Figure 6:
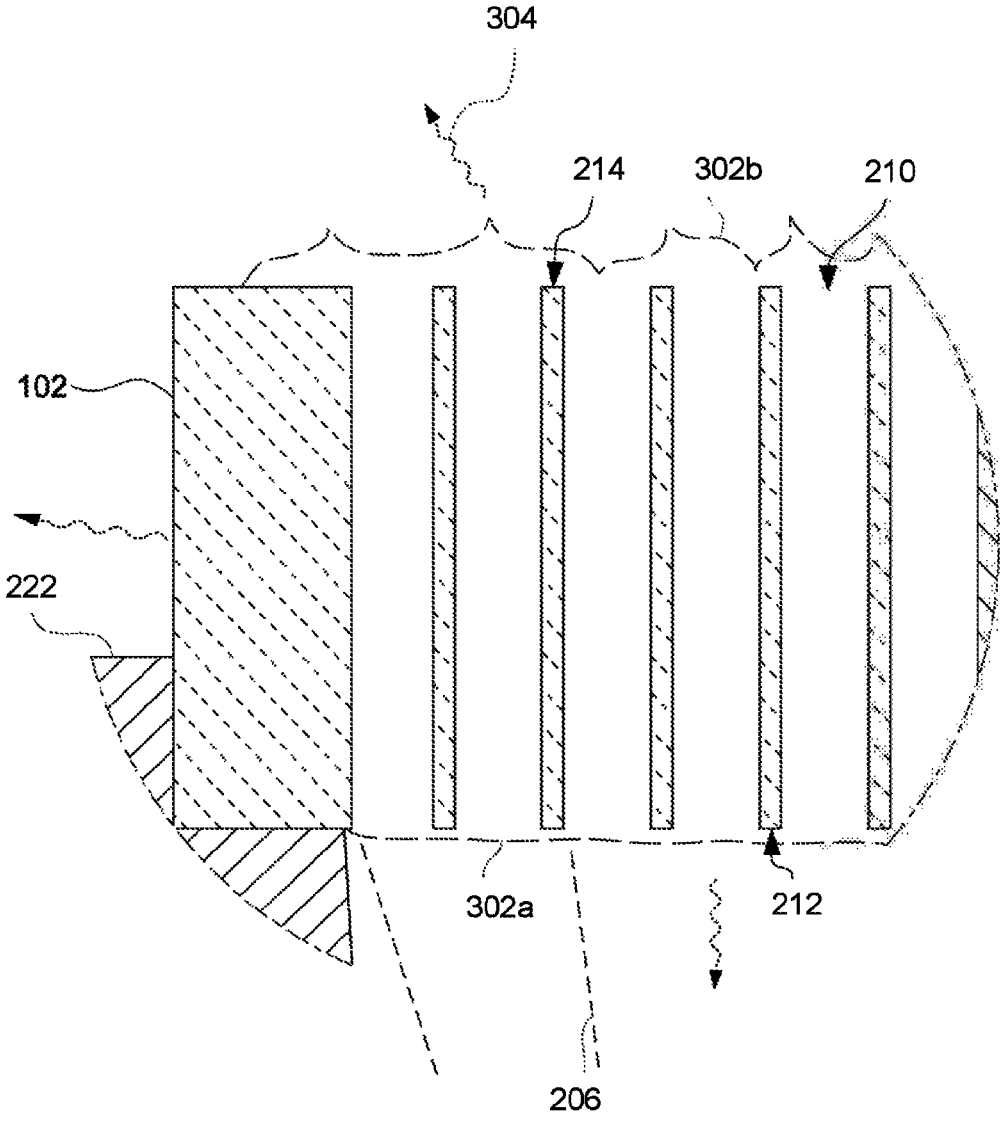
FIG. 6 shows a detail of the burner system of FIG. 5, as indicated at 6 in FIG. 5, according to an embodiment.

FIG. 6 shows a detail of the burner system 100 of FIG. 5, as indicated at 3 in FIG. 5, according to an embodiment. As shown in FIG. 6, during normal operation of the burner system 500, the upper boundary 302*b* and the lower boundary 302*a* of the flame may extend only a small distance above and below the flame holder 102, respectively. Thus, the majority of the fuel within the fuel stream 206 is combusted within the apertures 210 of the flame holder 102.

While the depiction of the flame edges 302*a*, 302*b* are illustrated in a manner intended for ease of description, it should be understood that in some instances, no visible flame is present. Combustion occurs primarily within the elongated apertures 210, but the "glow" of combustion heat is dominated by a visible glow of the perforated flame holder 102 itself. In other instances, the inventors have noted transient "huffing" wherein a visible flame momentarily ignites in a region lying between the input face 212 of the perforated flame holder 102 and the fuel source 218 (e.g., see FIGS. 2 and 5), within the dilution region $D_D$. Such transient huffing is generally short in duration such that, on a time-averaged basis, a majority of combustion occurs within the apertures 210 of the perforated flame holder, between the input face 212 and the output face 214 of the perforated flame holder 102. In still other instances, the inventors have noted apparent combustion occurring above the output face 214 of the perforated flame holder 102, but still a majority of combustion occurred within the perforated flame holder as evidenced by the continued visible glow (a visible wavelength tail of blackbody radiation) from the perforated flame holder 102.

Heat output of the perforated burner system 500 is controlled by regulation of the flow rate of fuel in the fuel stream. Heat output can be determined by direct measurement at the flame holder 102, or can be inferred indirectly, based on measurements taken at other locations within the system 100, such as at a flue outlet or at an outlet of a working fluid, etc. For example, on the basis of empirical data, a table can be prepared from which a heat output value can be derived, given a flow rate, based on an input temperature and an output temperature of a working fluid.

For the purposes of this disclosure, moderate heat output is heat output at values exceeding about 215 kBTU/H/ft$^2$ (1.5 Kbtu/H/in$^2$), and high heat output is heat output at values exceeding about 430 kBTU/H/ft$^2$ (3 kBTU/H/in$^2$).

During normal operation, according to an embodiment, heat output of the burner system 100 is greater than 500 kBTU/H/ft$^2$, or about 3.5 kBTU/H/in$^2$ (158 W/cm$^2$). In experiments conducted by the inventors, perforated flame holders like the one described above were routinely operated at heat outputs of about 1 MBTU/H/ft$^2$ (7 kBTU/H/in$^2$) or more, and in some tests, reached or exceeded levels of about 5 MBTU/H/ft$^2$ (35 kBTU/H/in$^2$).

According to respective embodiments, heat output of the burner system 100 is greater than 1 MBTU/H/ft$^2$ (about 7 kBTU/H/in$^2$), 3 MBTU/H/ft$^2$ (about 21 kBTU/H/in$^2$), and 5 MBTU/H/ft$^2$ (about 35 kBTU/H/in$^2$).

One of the factors that enables operation at these high levels of heat output is that, according to an embodiment, active combustion occurs substantially along the entire length of the apertures 210. As a result, the entire body of the flame holder 102 is held at a temperature at or above the auto-ignition temperature of the fuel component of the fuel stream 206. Thus, the fuel stream 206 is nominally ignited as it travels through the apertures 210 of the flame holder 102 and the combustion process is complete, or nearly so, by the time the reactants have traversed the length of the apertures 210 (e.g., the thickness of the flame holder 102). In many prior art systems, the output side of a ceramic burner tile is heated to a point where it radiates energy in infrared wavelengths, but the input side is cooled by the incoming fuel stream, and remains much cooler, particularly at moderate and high heat output, so that combustion begins only as the fuel stream 206 nears the output face 214 of the burner, or even beyond the output face 214. In fact, many prior art systems rely on the cooling effect of the fuel stream. As the Sarkisian reference explains, "the ceramic tile, which is cooled by the reactants, effectively insulates the upstream reactants from the hot downstream combustion products, preventing flashback."

In order to initiate operation of the burner system 100 and enable the levels of heat output described with reference to various embodiments, the perforated flame holder is preheated during a start-up procedure (or held indefinitely at an elevated temperature) such that at least a portion of the perforated flame holder 102 is at a temperature that exceeds the auto-ignition temperature of the fuel component of the fuel stream 206.

Any appropriate method of preheating the flame holder 102 can be employed. A number of structures and methods for preheating a perforated flame holder are disclosed, for example, in the PCT Application No. PCT/US2014/016632, entitled "FUEL COMBUSTION SYSTEM WITH A PERFORATED REACTION HOLDER," filed Feb. 14, 2014; which, to the extent not inconsistent with the disclosure herein, is incorporated by reference.

Figure 7:
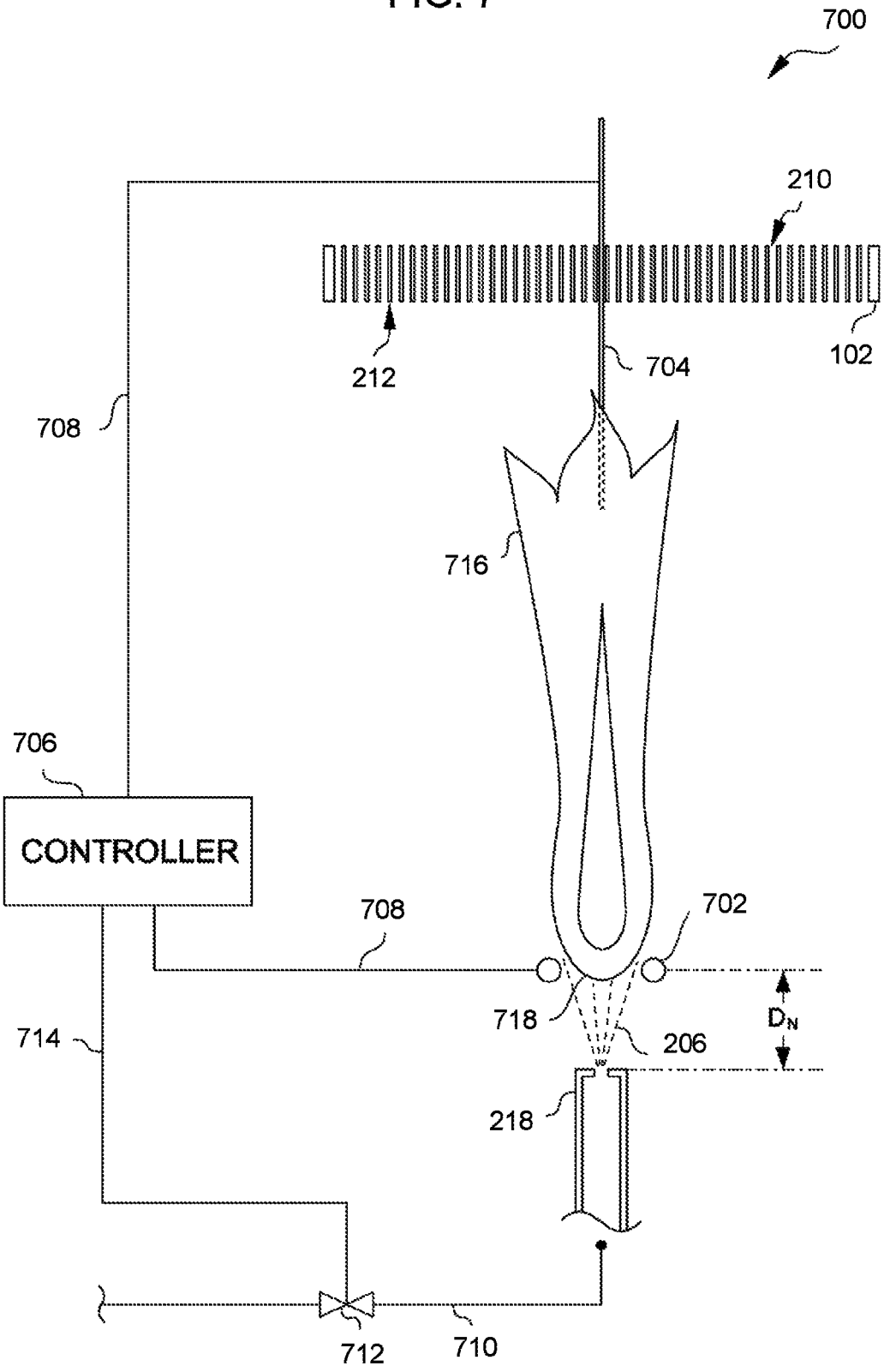
FIGS. 7 and 8 are diagrammatic views of a burner system during respective modes of operation, according to an embodiment.
Figure 8:
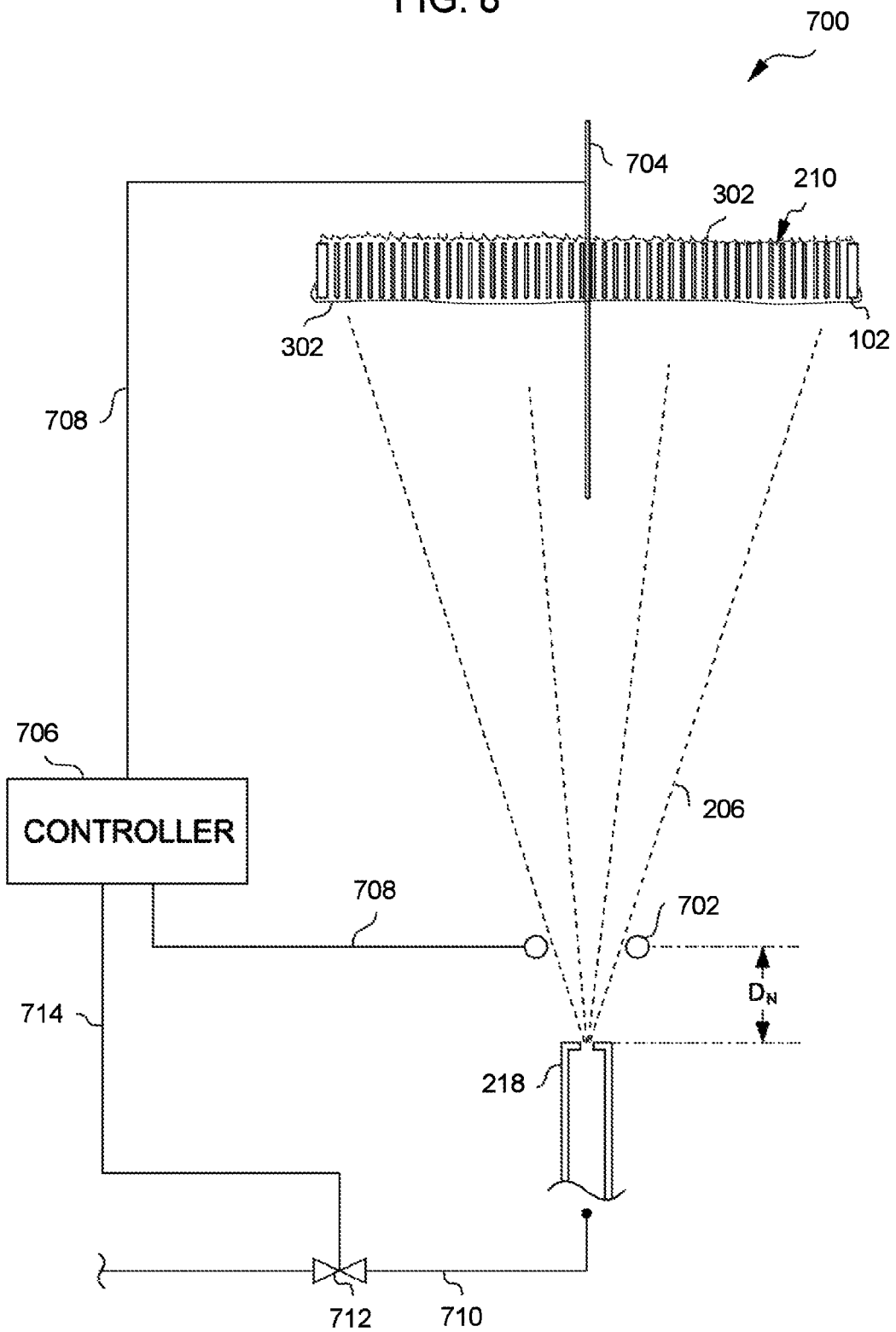

One structure and corresponding method for preheating the perforated flame holder 102 are described hereafter with reference to FIGS. 7 and 8.

FIGS. 7 and 8 are diagrammatic views of a burner system 700 during respective modes of operation, according to an embodiment. The burner system 700 includes a perforated flame holder 102 and a nozzle 218 as described above with reference to the burner system 100. Optionally, the burner system 700 includes a controller 706, and first and second electrodes 702, 704. The first electrode 702 is configured as a flame holder electrode, while the second electrode 704 is configured as a charge electrode. The controller 706 is operatively coupled to the first electrode 702 and the second electrode 704 via connectors 708, and is configured to apply an electrical potential across the first and second electrodes 702, 704.

In the embodiment shown, the first electrode 702 has an annular shape, such as, for example, the shape of a toroid, and is positioned a distance $D_N$ from the nozzle 218, with a center axis aligned with a longitudinal axis of the nozzle 218. During operation, a fuel stream 206 emitted from the nozzle 218 will preferably have a conical shape, with a diameter that increases as a function of the distanced from the nozzle 218. Typically, the angle of dispersion of the fuel stream 206 is about 15 degrees, relative to the longitudinal axis of the nozzle 218. According to an embodiment, an inside diameter of the first electrode 702 is selected to be greater than a diameter of the fuel stream 206 at the distance $D_N$. According to another embodiment, the inside diameter of the first electrode 702 is selected to be equal to, or slightly less than the diameter of the fuel stream 206 at the distance $D_N$.

The nozzle 218 is configured to receive a flow of fuel via a fuel line 710. A valve 712 is coupled to the fuel line 710, and is configured to regulate a flow of fuel to the nozzle 218. The controller 706 is operatively coupled to the valve 712 via a connector 714, and is configured to provide a signal on the connector 714 by which operation of the valve 712 is controlled.

In FIG. 7, the burner system 700 is shown in a preheat mode of operation. While operating in the preheat mode, the controller 706 controls the valve 712 to admit a flow of fuel to the nozzle 218 while simultaneously applying a voltage across the first and second electrodes 702, 704, and a preheat flame 416 is ignited in the fuel stream 206 by any of a number of well known methods. The second electrode 704 applies a charge of a first polarity to the preheat flame 416, while a voltage of an opposite polarity (or a ground potential) present at the first electrode 702 attracts charged species within the preheat flame 416. As a result, a flame front 418 of the preheat flame 416 is held in a region near the first electrode 702, which holds a substantial portion of the preheat flame 416 between the nozzle 218 and the perforated flame holder 102. With the preheat flame 416 in this position, the perforated flame holder 102 is heated by the flame 416.

According to an embodiment, the controller 706 is configured to apply an electrical potential that varies over time, such as, for example, an AC voltage, or an AC voltage with a DC offset. According to an embodiment, the electrical potential applied by the controller 706 has a peak-to-peak value that exceeds 10 kV. According to another embodiment, the electrical potential applied by the controller 706 has a peak-to-peak value that exceeds 20 kV. According to a further embodiment, the electrical potential applied by the controller 706 has a peak-to-peak value that exceeds 40 kV.

According to an embodiment, one or more amplifiers are provided, configured to receive a time-varying signal from the controller 706, to amplify the signal, and to provide the amplified signal to the first and second electrodes 702, 704.

In embodiments in which the inside diameter of the first electrode 702 is greater than the diameter of the fuel stream 206 at the distance $D_N$, there is no direct contact of the preheat flame 416 with the first electrode 702. Thus, there is no direct electrical path between the first and second electrodes 702, 704, and almost no electrical current. Accordingly, even though the voltage potential applied to the first and second electrodes 702, 704 can be very high, the power expended is minimal. For example, in an experimental combustion system operated by the inventors, with an applied peak-to-peak voltage of about 40 kV, power consumption was about 5 W.

When at least a portion of the perforated flame holder 102 has been heated to a selected minimum start-up temperature by the preheat flame 416, the burner system 700 transitions from the preheat mode to a heating mode (i.e., normal operation), as shown in FIG. 8. While transitioning to the heating mode of operation, the controller 706 terminates the application of the electrical potential across the first and second electrodes 702, 704, while continuing to control the valve 712 to admit fuel to the nozzle 218. Because of the velocity the fuel stream 206, in the absence of the charge applied to the flame 302 via the second electrode 704 and the counter charge present at the first electrode 702, the preheat flame 416 is blown off the holding electrode 702. However, the minimum start-up temperature of the perforated flame holder 102 is selected to be greater than the auto-ignition temperature of the fuel in the fuel stream 206. Thus, when the preheat flame 716 is no longer held by a start-up flame holder 702, the fuel stream 206 is ignited within the apertures 210 of the perforated flame holder 102, and stable combustion commences at the flame holder 102.

The optional controller 706 can regulate the heat output of the burner system 700 by controlling the volume of fuel admitted by the valve 712 and/or a volume of oxidant provided by a combustion air source. Combustion continues substantially as described with reference to FIGS. 2 and 5.

Turning now to FIGS. 9-12, flowcharts illustrating various methods of operation are shown, according to respective embodiments. It should be noted that in the methods disclosed hereafter, many of the steps disclosed are not mandatory or essential. Additionally, many steps disclosed with respect to one method can be combined with other methods, as appropriate, and according to the particular circumstances. For example, while only included as an element of the process of FIG. 9, the preheat step described with reference to step 106 can be incorporated into any of the disclosed methods, as appropriate.

Figure 9:
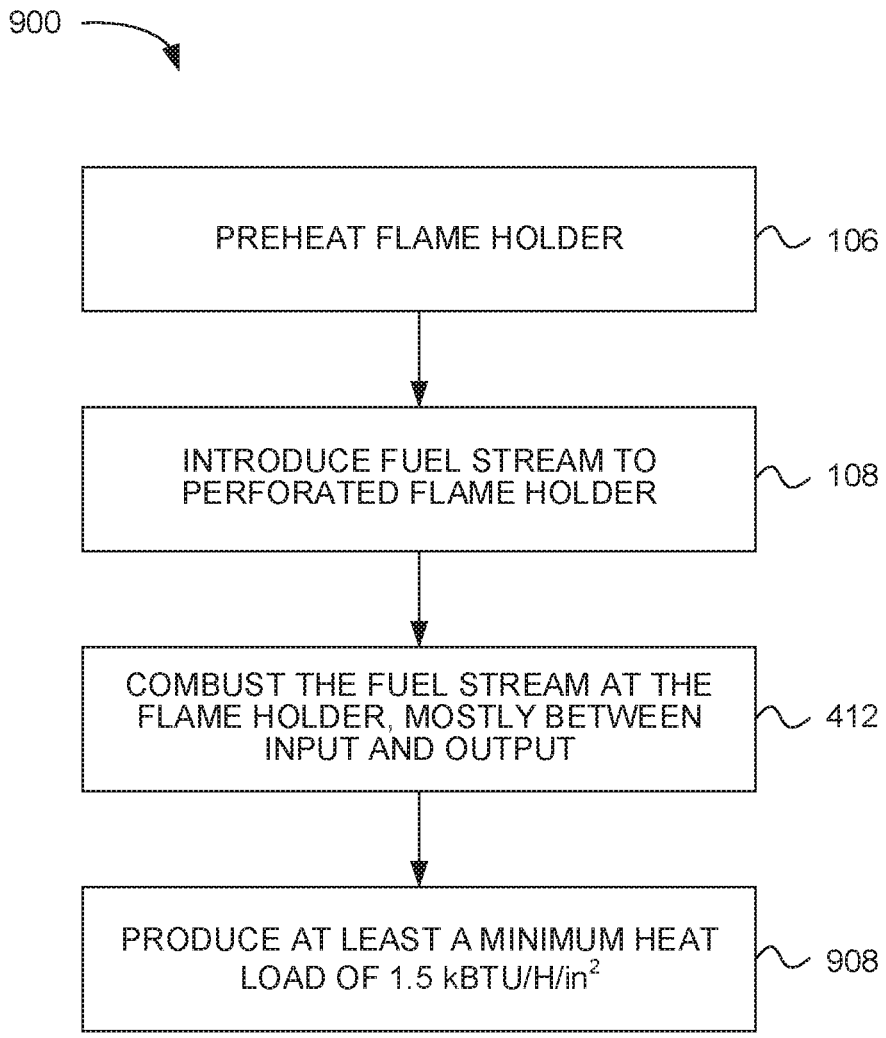
FIGS. 9-12 are flowcharts of methods of operating a burner system, according to respective embodiments.

FIG. 9 is a flowchart of a method 900 of operating a burner system, according to an embodiment. This method begins with the assumption that the burner is not initially in a heating operation or mode. In step 106, a perforated flame holder is preheated to a selected start-up temperature. This step may involve preheating only a portion of the flame holder, or alternatively, the entire flame holder can be preheated to the selected start-up temperature. According to an embodiment, the selected start-up temperature is a temperature that exceeds the auto-ignition temperature of the fuel component of the fuel stream. The selected start-up temperature can also be a temperature that exceeds the auto-ignition temperature of the fuel component of the fuel stream plus an incremental additional temperature selected such that the perforated flame holder can hold sufficient heat energy to sustain the combustion reaction for a period after start-up. During start-up, the inventors have found that the temperature of the perforated flame holder may tend to dip upon introduction of a cool fuel and oxidant mixture to the perforated flame holder. The incremental additional temperature is selected to maintain at least the auto-ignition temperature through this temperature dip of the perforated flame holder.

Once the selected minimum start-up temperature of the flame holder is achieved, the process advances to step 108, in which a fuel stream that includes a fuel component and an oxidant component is introduced to an input face of the perforated flame holder. It should be noted that emission of the fuel stream from a nozzle can begin as part of step 106, or can be started at the end of step 106. For example, in the preheating process described above with reference to FIGS. 7 and 8, the fuel stream initially supports the preheat flame, which is used during startup to preheat the flame holder. However, because the flame is held between the nozzle and the flame holder during the preheat step, the fuel stream, per se, does not reach the flame holder until the electrodes are de-energized. In other preheat processes, emission of the fuel stream does not begin until the flame holder is at its minimum start-up temperature. In such processes, the flame holder is preheated using other means, such as by an electrical heating element, laser bombardment, etc.

In step 412, the fuel stream is combusted, in majority, between the input face and an output face of the perforated flame holder. In this context, combustion of the fuel stream refers to the combustion process in which the fuel component is converted to combustion products. That is, a majority of the combustion process occurs between the input and output faces of the flame holder. Determination of the degree to which the combustion process is complete can be on any reasonable basis, including, for example, the percentage of fuel—i.e., the fuel component of the fuel stream—that is converted to combustion products between the input and output faces of the flame holder relative to the total amount of fuel that is converted within the burner system, or the percentage of thermal energy that is released by the process of combustion between the input and output faces of the flame holder relative to the total amount of thermal energy released within the burner system.

According to an embodiment, at least 80% of the combustion process occurs between the input and output faces of the flame holder.

Finally, in step 908, combustion of the fuel stream is used to produce at least a minimum heat output of the burner system, of about 216 kBTU/H/ft$^2$ (1.5 kBTU/H/in$^2$). According to another embodiment, the minimum heat output is about 432 kBTU/H/ft$^2$ (3 kBTU/H/in$^2$). According to respective further embodiments, the minimum heat output is about 7 kBTU/H/in$^2$, about 21 kBTU/H/in$^2$, and about 35 kBTU/H/in$^2$. 7 kBTU/H/in$^2$ corresponds to about 1 MBTU/H/ft$^2$ (i.e., one million BTUH per square foot, or about 15.4 million watts per square meter). Thus, 21 kBTU/H/in$^2$, and 35 kBTU/H/in$^2$ correspond, respectively, to about 3 MBTU/H/ft$^2$ and about 5 MBTU/H/ft$^2$.

Figure 10:
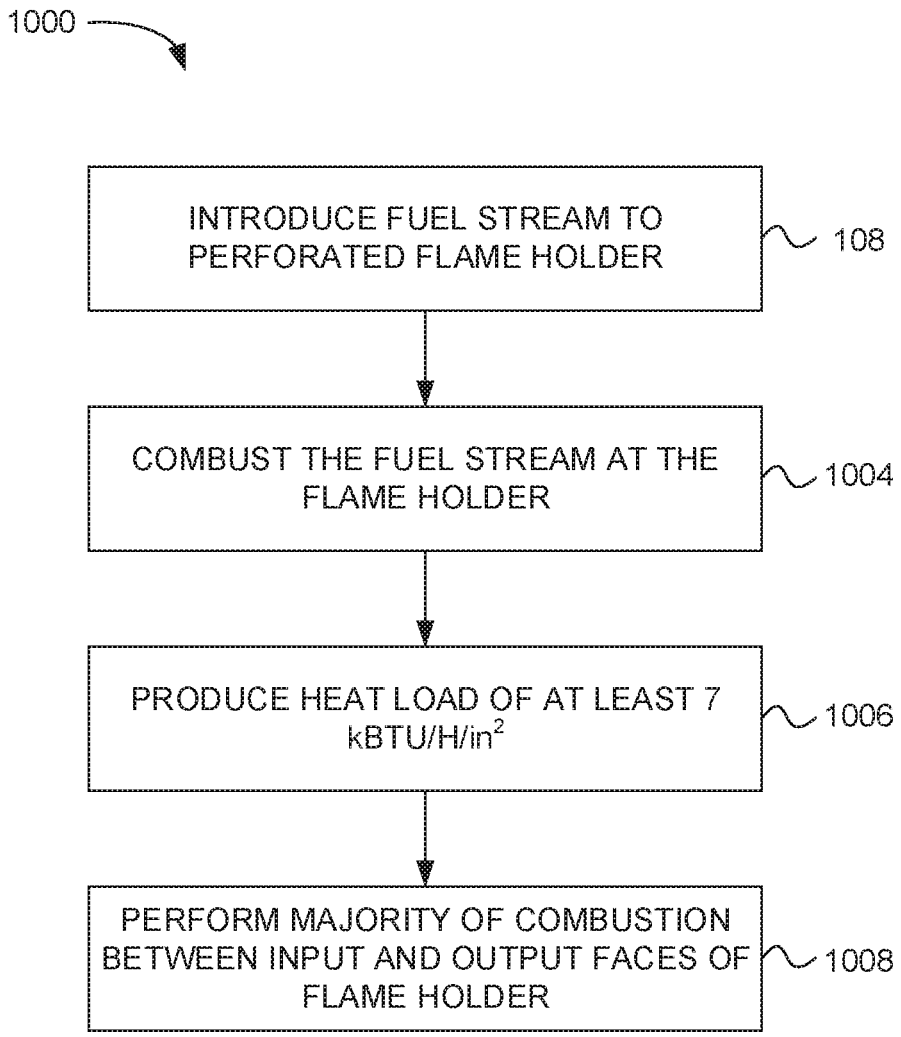

FIG. 10 is a flowchart of a method 1000 of operating a burner system, according to another embodiment. In step 108, a fuel stream that includes a fuel component and an oxidant component is introduced to an input face of a perforated flame holder, substantially as described above with reference to step 108.

In step 1004, the fuel stream is combusted at the perforated flame holder. In step 1006, combustion of the fuel stream is used to produce a heat output of the burner system of at least about 7 kBTU/H/in$^2$. According to respective alternative embodiments, combustion of the fuel stream is used to produce a heat output of at least about 21 kBTU/H/in$^2$, and at least about 35 kBTU/H/in$^2$.

According to an embodiment, as set forth in step 1008, a majority of the combustion is performed between the input face and an output face of the flame holder, substantially as described with reference to step 412.

Figure 11:
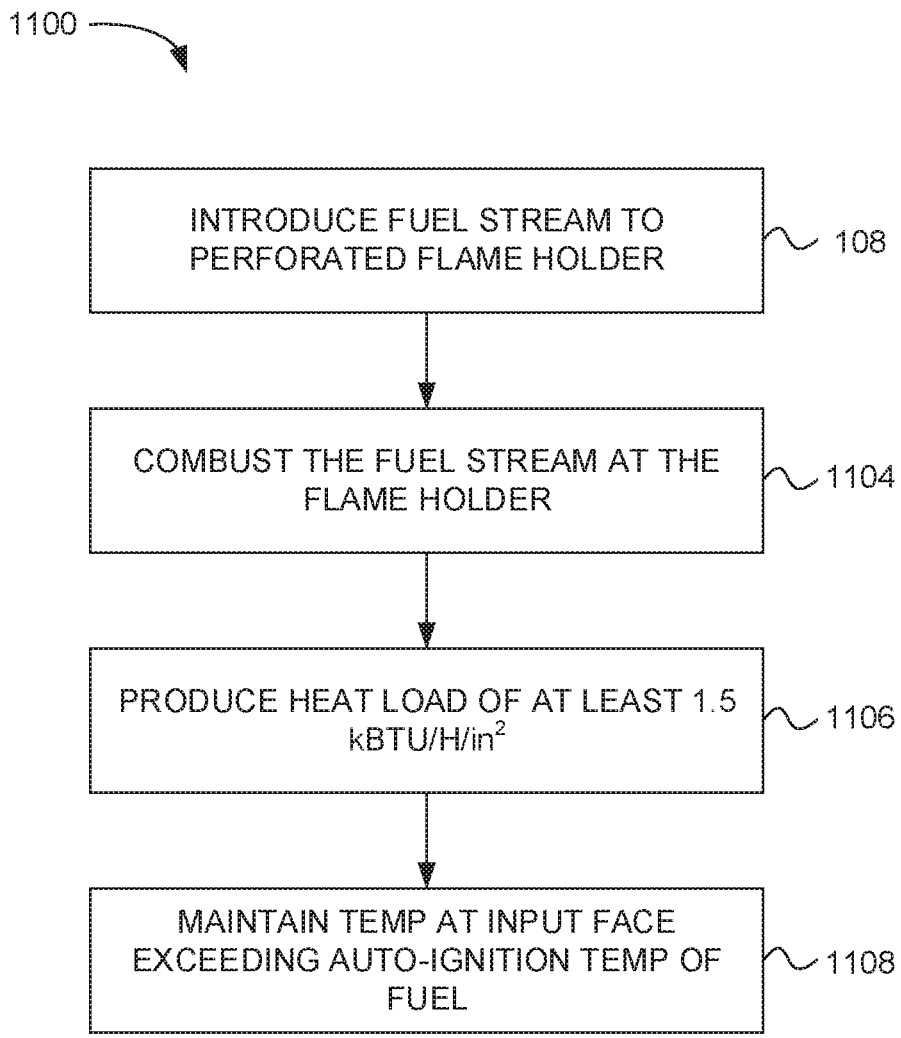

FIG. 11 is a flowchart of a method 1100 of operating a burner system, according to another embodiment. In step 108, a fuel stream is introduced to an input face of a perforated flame holder, substantially as previously described. In step 1104, the fuel stream is combusted at the perforated flame holder, and in step 1106, combustion of the fuel stream is used to produce at least a minimum heat output, of about 216 kBTU/H/ft$^2$ (1.5 kBTU/H/in$^2$). According to another embodiment, the minimum heat output is about 1 MBTU/H/ft$^2$.

In step 1108, while producing at least the minimum heat output, the input face of the flame holder is maintained at a temperature that exceeds an auto-ignition temperature of a fuel component of the fuel stream. According to an embodiment, the input face of the flame holder is maintained at a temperature of at least 1100 degrees F. (about 593 degrees C.).

According to an embodiment, combustion of the fuel stream is initiated as the fuel stream enters the input face of the flame holder. According to another embodiment, a majority of the combustion is performed between the input face and an output face of the flame holder.

Figure 12:
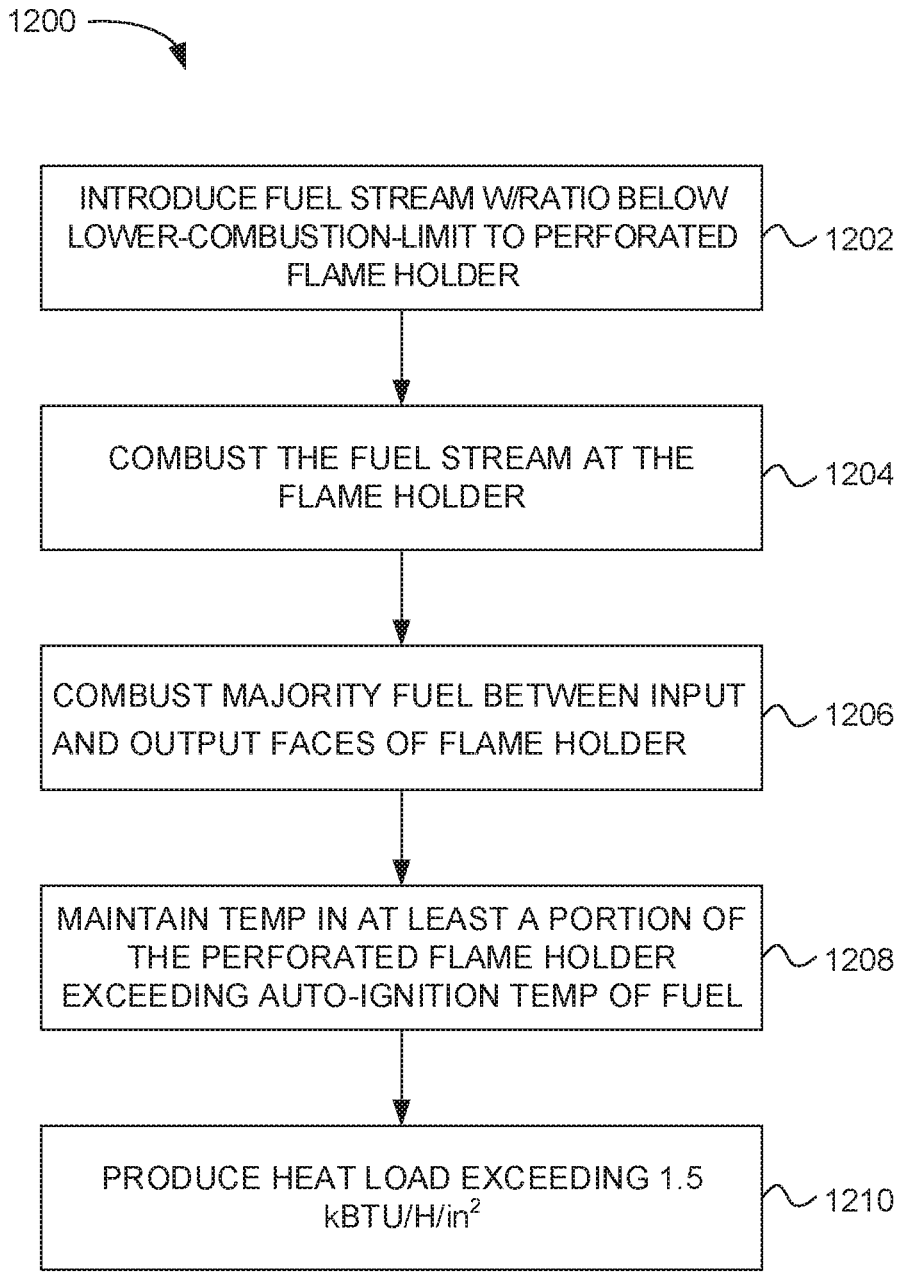

FIG. 12 is a flowchart of a method 1200 of operating a burner system, according to a further embodiment. In step 1202, a fuel stream is introduced to an input face of a perforated flame holder. The fuel stream of step 1202 has an average fuel-to-oxidant ratio that is below a lower combustion limit of a fuel component of the fuel stream. Nevertheless, in step 1204, the fuel stream is combusted at the perforated flame holder. According to an embodiment, as set forth at step 412, a majority of the combustion is performed between the input face and an output face of the flame holder.

According to another embodiment, as set forth at step 1208, at least a portion of the perforated flame holder is maintained at a temperature that exceeds an auto-ignition temperature of a fuel component of the fuel stream. According to an embodiment, as set forth at step 1210, combustion of the fuel stream is used to produce at least a minimum heat output, of about 216 kBTU/H/ft$^2$ (1.5 kBTU/H/in$^2$).

While various aspects and embodiments have been disclosed herein, other aspects and embodiments are contemplated. The various aspects and embodiments disclosed herein are for purposes of illustration and are not intended to be limiting, with the true scope and spirit being indicated by the following claims.

What is claimed is:

1. A method, comprising:

passing a fuel stream into a perforated flame holder having an input face, an output face, and a plurality of perforations extending between the input face and the output face;

combusting the fuel stream, with a majority of the combustion occurring between the input face and the output face of the flame holder;

producing a heat output from the combustion of at least 216 kBTU/H/ft$^2$; and prior to performing the combusting the fuel stream, preheating the perforated flame holder;

wherein the preheating the perforated flame holder comprises preheating at least a portion of the flame holder to a temperature that exceeds an auto-ignition temperature of a fuel component of the fuel stream.

2. The method of claim 1, wherein the combusting the fuel stream comprises completing at least 80% of the combustion of the fuel stream between the input face and the output face of the flame holder.

3. The method of claim 1, wherein the producing a heat output from the combustion of at least 216 kBTU/H/ft$^2$ includes producing a heat output from the combustion of at least 432 kBTU/H/ft$^2$.

4. The method of claim 1, wherein the producing a heat output from the combustion of at least 216 kBTU/H/ft$^2$ includes producing a heat output from the combustion of at least 1 MBTU/H/ft$^2$.

5. The method of claim 1, wherein the producing a heat output from the combustion of at least 216 kBTU/H/ft$^2$ includes producing a heat output from the combustion of at least 3 MBTU/H/ft$^2$.

6. The method of claim 1, wherein the producing a heat output from the combustion of at least 216 kBTU/H/ft$^2$ includes producing a heat output from the combustion of at least 5 MBTU/H/ft$^2$.

7. A method of operation, comprising:

passing a fuel stream into a perforated flame holder;

combusting the fuel stream at the flame holder;

producing a heat output from the combustion of at least 1 MBTU/H/ft$^2$; and prior to performing the combusting the fuel stream at the flame holder, preheating the perforated flame holder;

wherein the preheating the perforated flame holder comprises preheating at least a portion of the flame holder to a temperature that exceeds an auto-ignition temperature of a fuel component of the fuel stream.

8. The method of claim 7, wherein the combusting the fuel stream at the flame holder comprises combusting a majority of a fuel component of the fuel stream between an input face and an output face of the flame holder.

9. A method of operation, comprising:

passing a fuel stream into a perforated flame holder;

combusting the fuel stream at the flame holder; and producing a heat output from the combustion of at least 1 MBTU/H/ft$^2$;

wherein the combusting the fuel stream at the flame holder comprises combusting a majority of a fuel component of the fuel stream between an input face and an output face of the flame holder; and wherein the combusting a majority of a fuel component of the fuel stream between an input face and an output face of the flame holder comprises combusting at least 80 percent of the fuel component of the fuel stream between the input face and the output face of the flame holder.

10. A method of operation, comprising:

passing a fuel stream into a perforated flame holder;

combusting the fuel stream at the flame holder; and producing a heat output from the combustion of at least 1 MBTU/H/ft$^2$;

wherein the combusting the fuel stream at the flame holder comprises combusting a majority of a fuel component of the fuel stream between an input face and an output face of the flame holder; and wherein the combusting a majority of a fuel component of the fuel stream between an input face and an output face of the flame holder comprises combusting a majority of the fuel component of the fuel stream within apertures extending between the input face and the output face of the flame holder.

11. The method of claim 7 wherein the producing a heat output from the combustion of at least 1 MBTU/H/ft$^2$ comprises producing a heat output from the combustion of at least 3 MBTU/H/ft$^2$.

12. The method of claim 7 wherein the combusting the fuel stream at the flame holder at a rate of at least 1 MBTU/H/ft$^2$ comprises combusting the fuel stream at a rate of at least 5 MBTU/H/ft$^2$.

13. A method, comprising:

passing, into an input face of a perforated flame holder, a fuel stream having an average fuel-to-oxidant ratio that is below a lower combustion limit of a fuel component of the fuel stream;

combusting the fuel stream at the perforated flame holder;

wherein the combusting the fuel stream at the perforated flame holder comprises combusting a majority of the fuel component of the fuel stream between an input face and an output face of the perforated flame holder; and wherein the combusting a majority of the fuel component of the fuel stream between an input face and an output face of the perforated flame holder comprises combusting a majority of the fuel component of the fuel stream within apertures extending in the perforated flame holder between the input face and the output face.

14. The method of claim 13, comprising maintaining a temperature at an input face of the flame holder that exceeds an auto-ignition temperature of the fuel component of the fuel stream.

15. The method of claim 13, wherein the combusting the fuel stream at the perforated flame holder comprises combusting at least 80 percent of the fuel component of the fuel stream between an input face and an output face of the perforated flame holder.

16. The method of claim 13, wherein the combusting the fuel stream at the perforated flame holder comprises producing a heat output from the combustion of at least 1 MBTU/H/ft$^2$.

17. The method of claim 14, wherein the maintaining a temperature in at least a portion of the flame holder that exceeds an auto-ignition temperature of a fuel component of the fuel stream comprises maintaining a temperature at the input face of the flame holder of at least 1100 degrees F.

18. The method of claim 13, comprising initiating combustion of the fuel stream as the fuel stream enters the input face of the perforated flame holder.

* * * * *